US005332021A

United States Patent [19]

Todd et al.

[11] Patent Number: 5,332,021

[45] Date of Patent: Jul. 26, 1994

[54] FLEXIBLE RETRACTABLE DOOR

[76] Inventors: John M. Todd, 30 Pardon Drive, Downsview, Ontario, Canada, M3H 4X1; James A. Grieve, 248C Broadway Avenue, Toronto, Ontario, Canada, M4P 1V9

[21] Appl. No.: 880,491

[22] Filed: May 8, 1992

Related U.S. Application Data

[63] Continuation-in-part of Ser. No. 757,602, Sep. 11, 1991, abandoned.

[51] Int. Cl.[5] ..... E06B 9/08

[52] U.S. Cl. ..... 160/133; 160/192; 160/238; 160/201

[58] Field of Search ..... 160/23.1, 26, 32, 133, 160/188, 192, 201, 229.1, 230, 231.1, 231.2, 238, 264, 271, 313, DIG. 8

[56] References Cited

U.S. PATENT DOCUMENTS

| | | | |
|---|---|---|---|
| 778,228 | 12/1904 | Dodge et al. | 160/320 X |
| 1,295,712 | 2/1919 | Drew | 160/133 |
| 2,610,681 | 9/1952 | Schaap | 160/230 |
| 2,852,143 | 9/1958 | Taber | 211/49 |
| 3,110,533 | 11/1963 | Le Bron | 312/297 X |
| 3,195,616 | 7/1965 | Taber | 160/121 |
| 3,241,899 | 3/1966 | Donker | 312/116 |
| 3,542,445 | 11/1970 | Donker | 312/116 |
| 3,552,470 | 1/1971 | Metcalfe | 160/26 |
| 3,811,370 | 5/1974 | Boston, Jr. et al. | 98/94 |
| 3,992,751 | 11/1976 | Foster et al. | 16/197 |
| 4,122,559 | 10/1978 | Kelly | 4/149 |
| 4,235,494 | 11/1980 | Chu et al. | 312/297 |
| 4,288,992 | 9/1981 | Eliason | 62/256 |
| 4,294,302 | 10/1981 | Ricke, Sr. | 160/133 |
| 4,323,105 | 4/1982 | Berman et al. | 160/309 |
| 4,403,641 | 9/1983 | Reeder | 160/263 |
| 4,471,500 | 9/1984 | Long | 4/499 |
| 4,563,034 | 1/1986 | Lamb | 296/98 |
| 4,687,246 | 8/1987 | Mousel | 296/97 |
| 4,809,760 | 3/1989 | Lew | 160/120 |
| 4,848,437 | 7/1989 | Laniado et al. | 160/370.2 |
| 4,916,764 | 4/1990 | Meaden et al. | 4/558 |
| 5,033,132 | 7/1991 | Greenblatt | 4/608 |

FOREIGN PATENT DOCUMENTS

| | | | |
|---|---|---|---|
| 255074 | 10/1960 | Australia | 160/230 |
| 23842 | 2/1977 | Japan | 160/133 |

*Primary Examiner*—Blair M. Johnson

*Attorney, Agent, or Firm*—Rockey, Rifkin and Ryther

[57] ABSTRACT

A flexible, retractable assembly for use as a door, space divider, covering or the like which comprises a sheet such as Mylar polyester film having a permanent memory set to roll up on itself or otherwise retract automatically into a coil, accordion, or other compact configuration. The assembly is adapted to be stored on one side of an opening and then guided across the opening to fully or partially cover the opening. The permanent memory set of the sheet permits it to retract at least partially under its own force to eliminate or minimize the need for separate rewinding apparatus. The sheet may substitute for a variety of standard products including entryway doors, closet, cabinet and shower doors, screen doors and windows, room dividers, machinery guards and covers for various items such as florescent light fixtures. The sheet may be combined with decorative finishes including a tambour composite structure providing aesthetic and functional advantages.

17 Claims, 21 Drawing Sheets

FLEXIBLE RETRACTABLE DOOR

PRIOR APPLICATIONS

This application is a continuation-in-part of application Ser. No. 757,602, filed on Sep. 11, 1991, now abandoned.

SCOPE OF THE INVENTION

This invention relates to a flexible retractable assembly useful for a variety of purposes including various types of doors, space dividers, coverings and the like. Typical uses comprise entryway doors, cabinet doors, furniture doors, doors for enclosing bathtubs and showers and for closing closets and the like, various covers, and screens as used, for example, to cover an entrance from a patio to a home interior, window screens, and screen doors and windows for a lanai.

BACKGROUND OF THE INVENTION

Doors, bug screens, and other coverings of the type referred to are well known for many purposes. The various assemblies described herein are intended as substitutes for such conventional products.

In the context of doors for use in water containment applications such as about bathtubs and showers, known doors suffer a number of disadvantages- Rigid panel glass and/or plastic doors are known specifically adapted as tub and shower doors. Such doors have rigid fixed panels of glass or plastic opened by sliding or by being hinged typically either as a single hinged panel door or as a bi-fold door. Known rigid panel doors suffer the disadvantages that when hinged, they require space for the doors to swing or, when sliding, they do not permit full access to the tub or shower. When not open, the doors have the disadvantage of taking up a considerable amount of space.

Other door-like closures for water containment applications are well known as in the form of flexible slidable shower curtains hung from a bar above the tub/shower opening. While inexpensive, such curtains are frequently ineffective to prevent water leakage and considerable water damage can result especially through careless use as may frequently occur in hotels and the like. Attempts have also been made to use plastic sheets which can be pulled out to cover the shower opening and then rewound or refolded to conserve space when not in use. Such attempts have also not been successful from the standpoints of utility, cost and aesthetics.

In the context of doors for use in non-water containment, uses such as entryway doors, doors to close closets, cabinets and the like, many doors are known which are in effect, retractable. These include, notably, bi-fold doors and accordion doors. Both of these types of doors have the disadvantage that when retracted, they still impair entry to the opening and occupy a considerable amount of space. Typically, these doors are of a relatively substantial construction and, therefore, can be relatively expensive.

Hinged doors and sliding panel doors are also well known as having various disadvantages in that they interfere with otherwise usable space and/or limit the percentage of available access to the closet or other area being enclosed.

Current designs for screen doors, screen windows and room dividers also present problems since solid sliding doors, as well as solid frames for screens, occupy considerable space when not in use. Either they must be removed when not in use, or moved into wall openings for storage which is expensive and space consuming or they must remain visible which is unsightly.

SUMMARY OF THE INVENTION

Accordingly, to at least partially overcome the disadvantages of previously known devices, the present invention provides a flexible retractable assembly for use as a door, space divider, bug screen or other covering in a variety of applications. The assembly generally embodies a flexible sheet having a permanent or substantially permanent memory set as a coil to roll up on itself automatically as a spiral coil. The flexible retractable assembly in accordance with the invention provides an improved substitute for known doors in a large variety of applications as explained in the foregoing background section of this application.

It is an object of the present invention to provide a flexible retractable assembly for use in a wide variety of applications such as a door assembly for water-retaining bathtubs, and/or showers, for entryway doors, closet doors, room dividers, cabinet doors, screen doors and windows, and various covers such as a florescent light cover, all such assemblies having a simplified construction which may be easily and efficiently manufactured.

Another object is to provide new and improved assemblies which are of a durable and reliable construction and which may be efficiently and reliably assembled.

Another object is to provide flexible retractable assemblies which are simpler, lighter, easier to install or assemble than wood or glass doors, which are adaptable to non-linear and free form applications, and which provide substantially greater access to the opening to be closed.

In general respects, the present invention provides a flexible retractable assembly comprising:

- a flexible sheet having front and rear end edges and laterally extending side edges,
- said sheet having a permanent memory set to roll up on itself or otherwise form a compact configuration automatically, for example, as a spiral coil around an axis proximate said rear edge or as an accordion configuration,
- locating means retaining said coil or other configuration at one side of an opening,
- guide means guiding said sheet from the locating means across the opening,
- wherein by the sheet moving from the locating means, the sheet is movable between:
  - (a) a retracted position with the front end edge near the locating means and the substantial entirety of the sheet in a compact state, and
  - (b) one or more extended positions with the front end edge spaced from the locating means and a substantial portion of the sheet extending at least partially across the opening.

These general characteristics of the assembly are utilized for each of the various applications of the invention by combining certain additional features to achieve specific functions. Thus, the sheet may be employed as a door for a shower and means are then provided to avoid splashing of water outside the shower area. In the case of a closet door, a tambour arrangement or other stiffening means may be added to improve the aesthetics and/or to provide a more sturdy construction. A screen door or window function may be achieved by utilizing a self-retracting sheet with openings for the passage of air. The accompanying drawings and description thereof set forth these and other such features which all form part of the inventive subject matter.

BRIEF DESCRIPTION OF THE DRAWINGS

FIG. 13 is a schematic view of a variation of the invention applied to a shower door or the like;

FIG. 17 is a schematic view of a variation of the invention applied to a closet door or the like;

FIG. 41 is a perspective view of a sheet variation which is provided with individual flat segments for attachment of a tambour or the like;

DETAILED DESCRIPTION OF PREFERRED EMBODIMENTS

Figure 1:
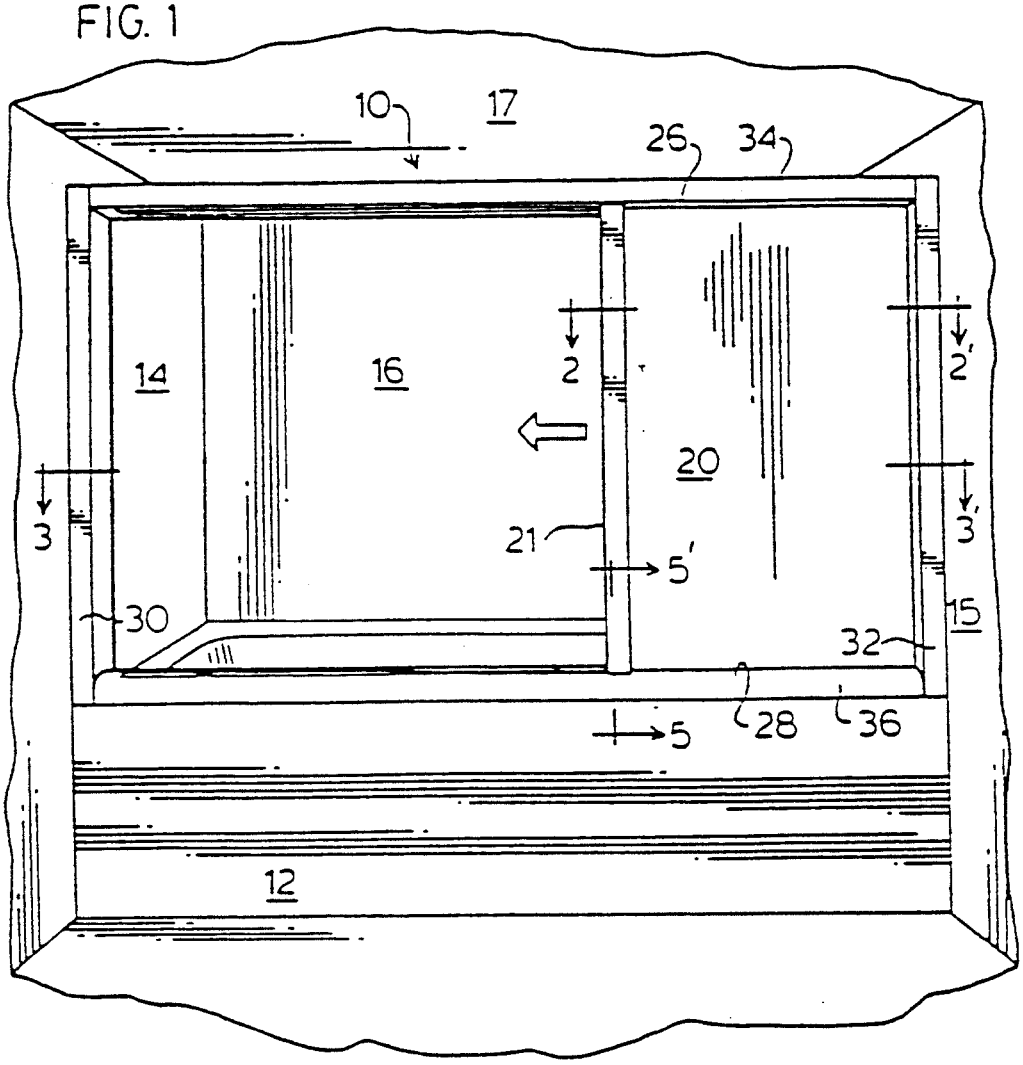
FIG. 1 is a perspective view of a bathtub shower flexible retractable door assembly comprising a first embodiment of the present invention showing the assembly operatively mounted on a bathtub.
Figure 2:
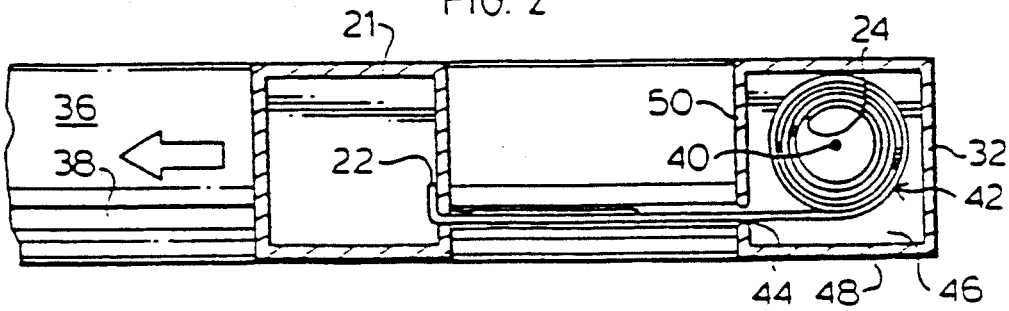
FIG. 2 is a cross-sectional plan view along line 2—2' in FIG. 1.

Reference is made first to FIG. 1 which shows as a first embodiment of the invention, a shower door assembly generally indicated 10 positioned to open and close the access opening to a bathtub 12, otherwise enclosed by side walls 14 and 15, end wall 16 and ceiling 17. The door assembly 10 is shown to comprise a rectangular frame and a door. The door comprises a rigid handlebar 21 and a rectangular sheet 20. As seen in FIGS. 1 and 2, sheet 20 has a front edge 22, a rear edge 24 parallel the front edge, and parallel upper and lower side edges 26 and 28. The frame has left side frame member 30, right side frame-and-coil locating member 32, upper frame and guide channel forming member 34 and lower frame and guide channel forming member 36.

Figure 5:
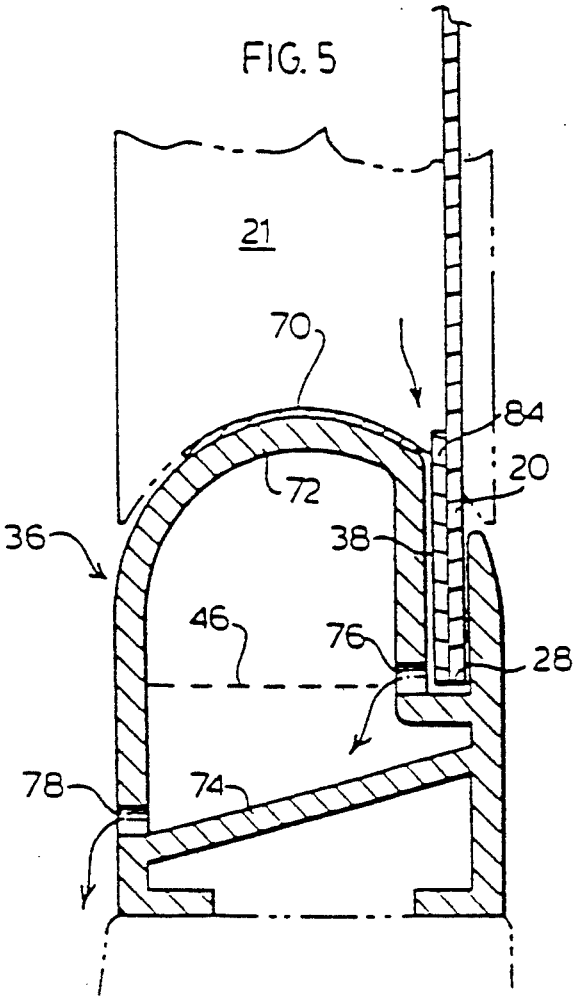
FIG. 5 is a partial cross-sectional view along line 5—5' of FIG. 1.

The upper and lower members 34 and 36 are formed with channels to receive and guide the upper and lower side edges 26 and 28, respectively, of the sheet 20 across the opening of the tub from the locating member 32. This is best illustrated in FIG. 5 with reference to the lower channel forming member 36 having an elongate channel 38 to receive therein lower edge 28 of the sheet.

Sheet 20 comprises a sheet of material having a permanent or substantially permanent memory set so as to roll up upon itself automatically as a spiral coil 42 about its axis indicated 40. The nature and memory of the sheet 20 is described later in more detail.

Coil locating member 32 is shown as an elongate hollow tubular member of generally rectangular configuration having a vertical slot 44 therethrough through which the sheet passes from the coil 42 and into the channels in the upper and lower frame members which guide the sheet across the opening of the tub enclosure.

Figure 3:
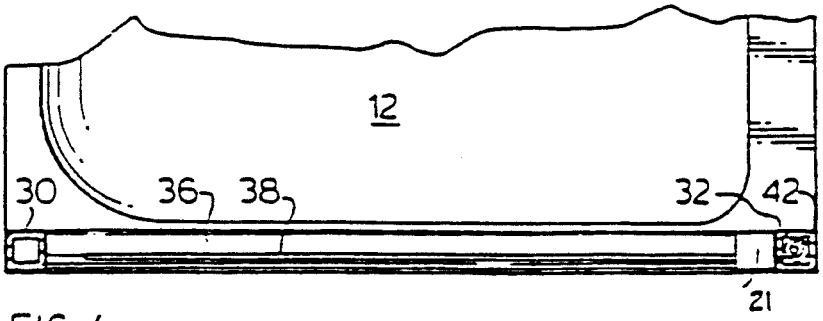
FIGS. 3 and 4 are cross-sectional plan views along line 3—3' of FIG. 1 showing the door assembly in retracted and extended positions, respectively.
Figure 4:
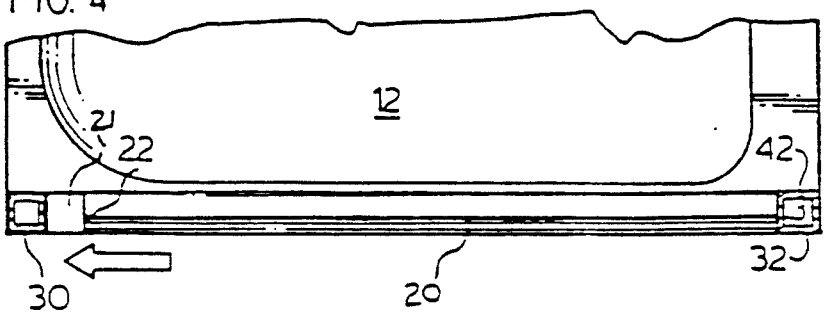

In use, on a person manually pulling or pushing handlebar 21, the door is movable between the retracted (open) position shown in FIG. 3 and the extended (closed) position shown in FIG. 4. In movement between positions, the coil 42 rotates about its axis 40. In the retracted position, the handlebar 21 to which the front edge 22 of the sheet is secured is near the coil 42 and the substantial entirety of the sheet is coiled about axis 40 so as to form the coil 42. In the extended position, as seen in FIG. 4, front edge 22 carried by handlebar 21 is spaced from the coil 42 which remains inside frame member 32 and a substantial portion of sheet 20 is uncoiled and extends across the opening of the tub with its upper and lower edges received in the channels of the upper and lower frame members. In the retracted position as seen in FIG. 3, the substantial majority of the enclosure is open for access.

Sheet 20 rolls up upon itself into a spiral coil 42 about its axis 40. It is to be appreciated that the axis 40 may not be precisely located and thus may be considered to be imaginary. The axis 40 may, for example, represent the general center of the coil 42 about which the coil exists. Embodiments may be configured to permit the axis or center of the coil to be movable.

Sheet 20 is preferably of a resiliently flexible material, such as the polyester film of E.I. du Pont de Nemours & Co. (Inc.) known by the trademark Mylar, which is capable of being prestressed with a substantial permanent curvature of a small radius and relatively long duration memory. The sheet material of sheet 20 is prestressed to have a permanent or substantially permanent memory set in any predetermined shape and, more particularly, to roll up on itself automatically forming a spiral coil 42 around axis 40 proximate the rear end edge 24. The coil has a memory such that it will return to its tight coiled form even though repeatedly unrolled or left unrolled for relatively long periods of time. While the sheet material is preferably polyester film, other films may be used which are capable of being prestressed to have this permanent coil set and memory. The sheet 20 may comprise a sheet material of one of the types disclosed in Donker U.S. Pat. Nos. 3,241,899, 3,542,445, or generally referred to in Taber U.S. Pat. Nos. 2,852,143 or 3,195,616. A preferred form of the sheet comprises Mylar with a nominal dimension of 0.01 inches in thickness or greater, such sheets measuring, for example, in the order of 0.007 inches in thickness. A preferred range is 0.007 to 0.02 inches although thicker or thinner sheets may be used.

Sheet material 20 has an inherent memory, whereby, when unrolled, it tends to recoil itself in the form of the coil 42. On movement from the retracted open position of FIG. 3 to an extended closed position of FIG. 4, forces are manually applied to the roll so as to unroll it. On release of these forces, in the absence of friction, sheet 20 would tend to assume its memory position and thereby reform the coil within frame member 32. To permit the sheet 20 to remain retracted in a fully retracted position or at any selected position intermediate the fully retracted and fully extended positions, it is preferred that there is a mechanism for retaining the handlebar 21 at any position between the fully extended and fully retracted position when it is released. In the first embodiment, this is provided, at least in part, by friction between the sheet 20 or handlebar 21, and, the upper or lower frame members 34 and 36.

While not clearly shown in FIG. 2, coil 42 rests upon a support surface generally indicated 46 by contact between supporting surface 46 and lower side edges 28 of the sheet. As schematically illustrated in FIG. 5, support surface 46 is disposed in the same horizontal plane as the lowermost surface of the channel 38. Support surface 46 is provided to have a low friction so as to facilitate uncoiling and sliding of the side edges of the coil thereon. This is advantageous to facilitate unwinding of the coil and its return to a retracted, coiled position.

In the first embodiment, locating member 32 is disposed circumferentially about coil 42. While shown rectangular, other configurations would be suitable. Member 32 has a forward face 48 in the plane of the bathtub opening and a side face 50 directed towards the opening. As seen, vertical slot 44 is preferably offset from the center of the side face 50 so as to be located in side face 50 proximate forward face 48 and in alignment with the channels in the upper and lower frame members 34 and 36. Offsetting the vertical slot 44 in the locating member 32 provides for enhanced guiding and locating of the coil 42 within the member 32 as by contact of the outer surfaces of the coil with inner surfaces of the locating member 32. Slot 44 may be offset to either the forward face or rear face of member 32, depending on whether the coil is coiled clockwise or counterclockwise as seen above.

Figure 6:
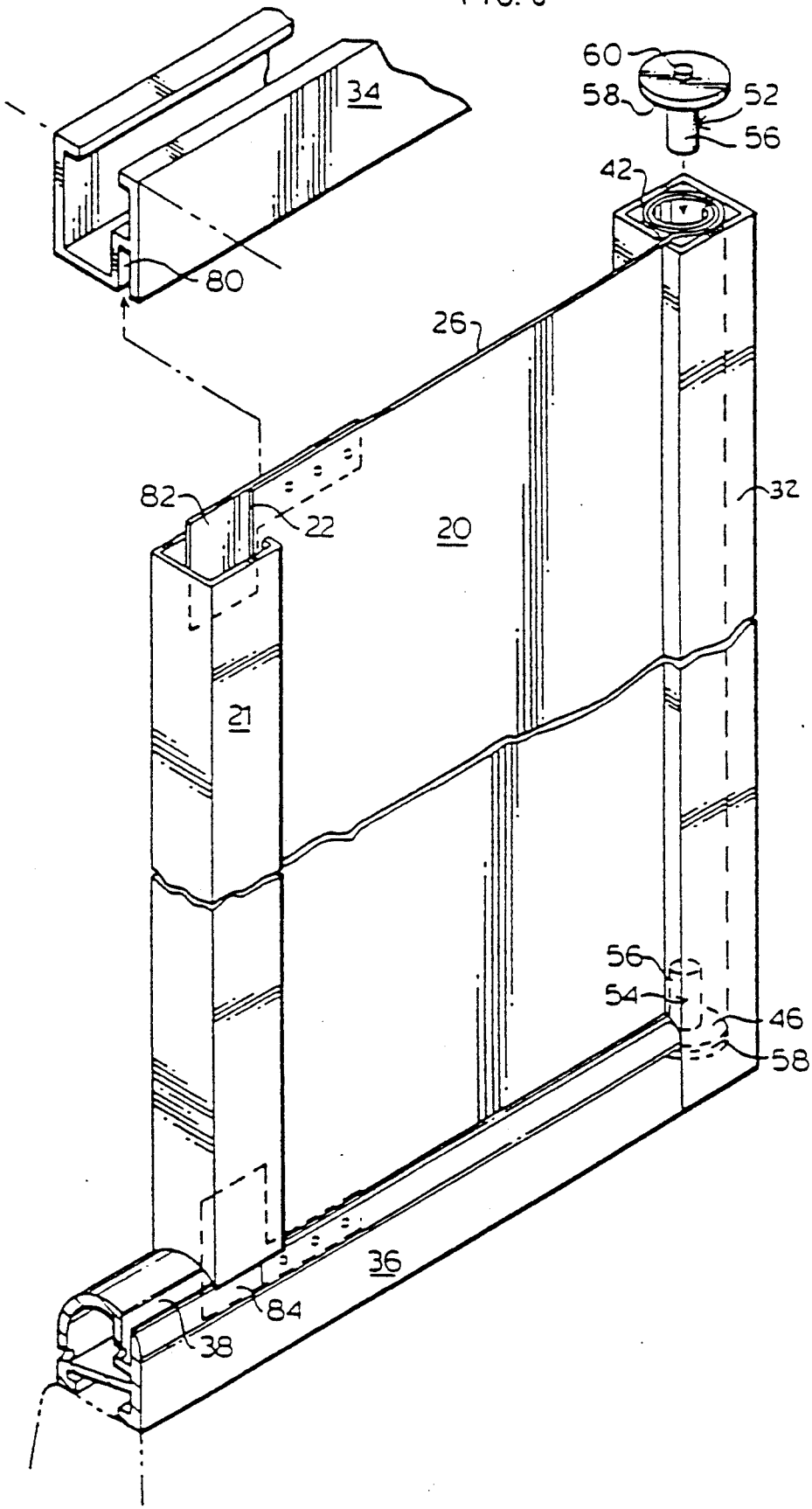
FIG. 6 is a schematic partially cross-sectional and partially exploded view of a second embodiment of the invention similar to the first embodiment in many respects.
Figure 7:
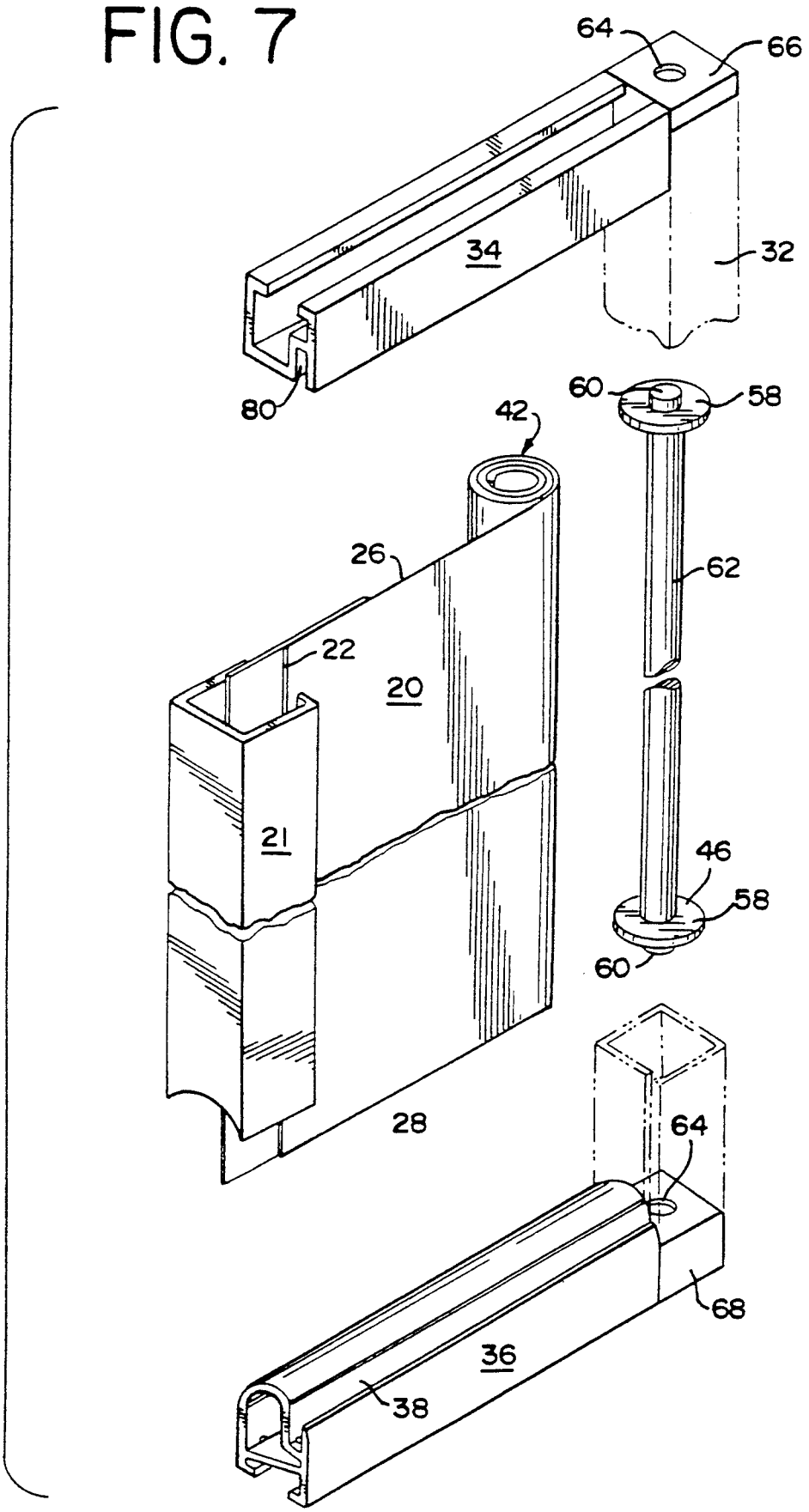
FIG. 7 is a partial, exploded perspective view of a third embodiment of the present invention having features in common with the first and second embodiments.

Reference is now made to FIGS. 6 and 7 showing second and third embodiments which are similar to the first embodiment differing principally in the manner in which the roll is located. In all the figures, similar reference numerals are used to indicate similar elements.

Referring to FIG. 6, this assembly is identical to that shown in FIGS. 1 to 5 with the exception that in addition to the coil being located by being received within locating member 32, preferably identical, part-axle members or centering posts 52 and 54 are inserted into the upper and lower open ends of coil 42. Each centering post 52 and 54 has a stub axle 56, a radially outwardly extending flange 58 and a cylindrical centering button 60. With the stub axle 56 inserted inside coil 42, one surface of flange 58, for example, upper surface 46 of flange 58 of lower centering post 54 is in contact with the lower side edge of the sheet 20. Lower centering post 54 is journalled within member 32 for rotation about axis 40 and with its upper surface 46 located at a suitable height as, for example, indicated in FIG. 5 with respect to the first embodiment. By reason of centering post 54 being journalled for rotation, this assists in permitting the sheet 20 to coil and uncoil in extending and retracting of the door.

The embodiment of FIG. 6 is preferred in that centering posts 52 and 54 are not fixed to the sheet 20 but rather, for easier assembly, manufacture and replacement, merely rest within the center of the coil.

Reference is now made to FIG. 7 which shows an exploded view of a third embodiment in accordance with the present invention.

In FIG. 7, locating member 32 is shown in dotted lines to indicate it is optional. Upper and lower locating end plates 66 and 68 are provided each having a centering aperture 64 to receive the centering buttons 60 of a unitary axle member 62 which is rotatably journalled for rotation about axis 40. Axle member 62 has flanges 58 of which the lower flange 58 has an upper supporting surface 46 to support and engage the lower side edge 28 of the sheet 20. The axle member 62, thus, by itself, can locate the roll 42 adjacent one side of the bathtub enclosure without the need for locating member 32 of the first and second embodiments. Locating member 32 may alternately be provided as indicated, for example, in dotted lines in FIG. 7.

In the context of FIG. 7, it is also preferred that sheet 20 is not fixed to the axle member 62, however, in certain circumstances it may be advantageous to secure the rear end 24 of sheet 20 to axle member 62.

While FIG. 7 is the only figure which shows the locating member 32 as optional, it is to be appreciated that locating member 32 could be eliminated in other embodiments, for example, in the embodiment of FIG. 6.

While the first three embodiments show different configurations for locating the coil 42 adjacent one side of the tub closure, many other hybrid configurations are apparent. For example, the embodiment of FIG. 7 could be modified so as to merely provide short part-axle members similar to centering posts 56 which extend upwardly and downwardly a short distance from each of the holes 64 in the plates 66 and 68 in FIG. 7. These centering posts 56 could be fixed in the hole 64 without rotation. With frame member 32 removed, a simple and pleasing configuration would appear with the roll being permanently seen as a tubular column at the side of the tub. This would be particularly so if, when in a fully retracted position as shown in FIG. 3, a sufficient quantity of the roll remains uncoiled so as to at all times give the appearance of a cylinder.

All of the first three embodiments are illustrated as having the same handlebar 21 and configuration of the upper and lower frame 34 and 36.

Lower frame member 36 may be extruded from suitable materials such as plastics or metal including aluminum with channel 38 provided therein. The lower member 36 is secured to the upper outer edge of the bathtub 12 so as to form a water impermeable seal therewith and therefore retain water within the enclosure when the door is closed. The illustrated extruded member 36 has a pleasing, exemplary rounded upper surface with the lower surface of the handle bar 21 similarly configured. A low friction sliding pad 70 is secured to the lower surface of the handlebar 21 to permit the handlebar to readily be slid on the frame member 36. While many shapes and profiles are suitable for the extruded member 36 and for the handlebar 21, the illustrated curvature of the bottom of the handlebar and frame member 36 is one configuration which assists in providing accurate location of the handlebar 21 above the lower frame 61.

In addition to the domed upper wall 72 of the frame member 36, an internal bevelled rib 74 is provided within member 36 and this serves to permit water which may accumulate within channel 38 to pass via an opening 76 internally into the channel and then into the tub enclosure via spaced openings 78 as indicated by the arrows in FIG. 5.

FIGS. 6 and 7 show the upper frame member 34 as comprising an extruded member which is secured horizontally across the tub enclosure supported as, for example, shown in FIG. 1 by being secured to the walls 14 and 16 about the tub enclosure preferably via side frame member 30 and any locating member 32. Upper frame 34 has an upwardly extending channel 80 to engage the upper side edge 26 of sheet 20 and guide the same across the tub enclosure.

The first three embodiments illustrated in the drawings all show a preferred system for maintaining the front edge 22 of the sheet 20 oriented parallel the axis 40 about which the coil unwinds so as to assist in maintaining the door in vertical alignment in the plane of the opening as is advantageous for smooth rolling and unrolling of the door with the sheet to slide smoothly within the channels of the upper and lower frame members. Vertical alignment is also preferred from an aesthetic view, that is, in appearance. FIG. 6 thus shows rigid upper and lower plate members 82 and 84 each having an L-shaped configuration and secured both to the upper and lower front corners of the sheet 20 and the handlebar 21. These plates 82 and 84 extend into the channel 38 of the lower frame member 36 and the channel 80 of the upper frame member 34. Channels 38 and 80 are provided of sufficient width to permit sliding of the combined plate 82 or 84 and sheet 20 as best seen in FIG. 5. The rigidity provided by rigid plates 82 and 84 assists in preventing bending of the sheet 20 about its front edge 22 as may particularly increase the friction or force required to slide the sheet within the upper and lower frame members.

Rigid plates 82 and 84 are fixedly secured to handlebar 21 and together they assist in ensuring the sheet 20 is maintained square with its front edge vertical. In this regard, FIG. 6 shows in exaggerated form the plate 82 extending rearwardly from the front edge 22 of the sheet 20. With the plates 82 and 84 spaced a vertical distance such that their upper and lower surfaces closely engage the end surfaces of the respective channels 80 and 38, such engagement serves to maintain handlebar 21 square vertically between the upper and lower frame members thus ensuring the front edge 22 of the sheet is maintained vertical. In the embodiment of FIG. 6, to the extent the plates 82 and 84 extend rearwardly from the front edge 22 of the sheet, this will impair the ability of the door to fully retract into locating member 32. It is, therefore, preferred that the rigid plate 82 be of reduced length and extend either only the width of the handlebar 21 or extend forwardly from the handlebar 21. Many other configurations may be provided for maintaining the handlebar and front edge 22 square to the frame member 12, for example, including spaced wheels or other slide members to engage and contact surfaces in complimentary upper and lower frame members. Plates 82 and 84 by reason of being relatively closely received between the sides of the channels also serve to prevent twisting of the handlebar 21.

It is to be appreciated that the handlebar 21 and plates 82 and 84 of the preferred embodiments are not necessary and that by selection of the sheet 20 to have sufficient inherent stiffness that these bars and plates could be eliminated in their totality. It is preferred that some handle be provided even if it may be in the form of a simple plastic or metal strip possibly only marginally wider than the sheet 20 and coupled to extend vertically along the forward edge 22. Such a bar may or may not be received within the channels in the upper and lower frame members.

The embodiments show the sheet material as comprising a unitary sheet. The sheet may, however, comprise a composite of Mylar and other materials. For example, other sheet material may be attached, bonded or laminated to a Mylar sheet to improve decorative appearance or mildew control. In addition, the Mylar could have bactericidal or antimycotic compounds incorporated directly therein. The bonding or lamination of Mylar or other material as may be suitable to provide a more substantial door and, particularly, one which may have increased rigidity in a vertical direction against bending other than as is necessary for coiling. For example, a material having corrugations which extend vertically could be coupled or laminated to the Mylar sheet 20 or other vertically extending reinforcing devices could be provided at spaced locations coupled to the Mylar. It is generally preferred, however, that sheet 20 comprise merely a single sheet of Mylar material having sufficient thickness to provide sufficient vertical rigidity such that the sheet 20 will not bend vertically so as to reduce its overall height and permit its upper side edge to become disengaged from the upper channel 80. Use of the unlaminated Mylar material is most economical.

The door assembly preferably is to be configured such that frictional force arising in moving the curtain between the retracted and extended positions is minimized. However, the assembly should preferably be configured such that the curtain will maintain any position between the retracted and extended positions in which it is placed. The Mylar sheet, if formed so that the entirety of the sheet will form in the shape of a coil, will have a tendency for the front end edge of the roll to coil itself. This coiling of the forward edge can be utilized so as to permit this front edge, when not manually moved, to coil into friction engagement within the channels of the frame member and, thus, act as a stop. To the extent this may be desired, when prestressing the sheet 20 to have a desired configuration, a separate "memory" can be applied to the front edge of the sheet 20 so as to provide an increased or decreased coiling and achieve a desired stopping power.

An alternative retaining system would be to provide a magnetic strip along one or both of the upper and lower channels 38 and 80 and an interacting ferromagnetic material strip near the upper front corners of the sheet. Such low strength magnetic strips could be provided so as to permit sliding of the sheet material between the retracted and extended positions yet when released, retain the door against closing under the memory forces of the coil. Providing the ferromagnetic strip near the front edge of sheet 20 may be advantageous to use in combination with the magnetic forces and the inherent tendency of the leading front edge to recoil. It will be understood, of course, that a magnetized strip may be applied to either the sheet or the channels, and the ferromagnetic material then used on the other surface.

The illustrated embodiments show a frame including both upper and lower frame members 34 and 36. It is to be appreciated that only one of the upper and lower frame members may be necessary particularly insofar as the handlebar 21 may be provided and the one of the upper frame member or lower frame member may sufficiently guide the sheet to maintain it in a desired configuration. For example, a more elaborate carriage could be provided to be engaged by only one of the upper and lower members.

The preferred embodiments shown provide relatively substantial upper and lower frame members. It is to be appreciated that in a simplified form these frame members could comprise relatively small and simple extrusions which would be extremely economical. As well, a simple extrusion may be provided so as to be secured to the tub enclosure in a curved configuration as may be advantageous to have the door follow the outline of an oval or curved tub or other enclosure.

Flexible retractable doors in accordance with the present invention may readily be adapted to be sold as a kit ready-to-install, for example, as a bath enclosure, a shower enclosure or a closet enclosure. The kit could include all necessary elements, including all necessary framing and hardware.

Figure 8:
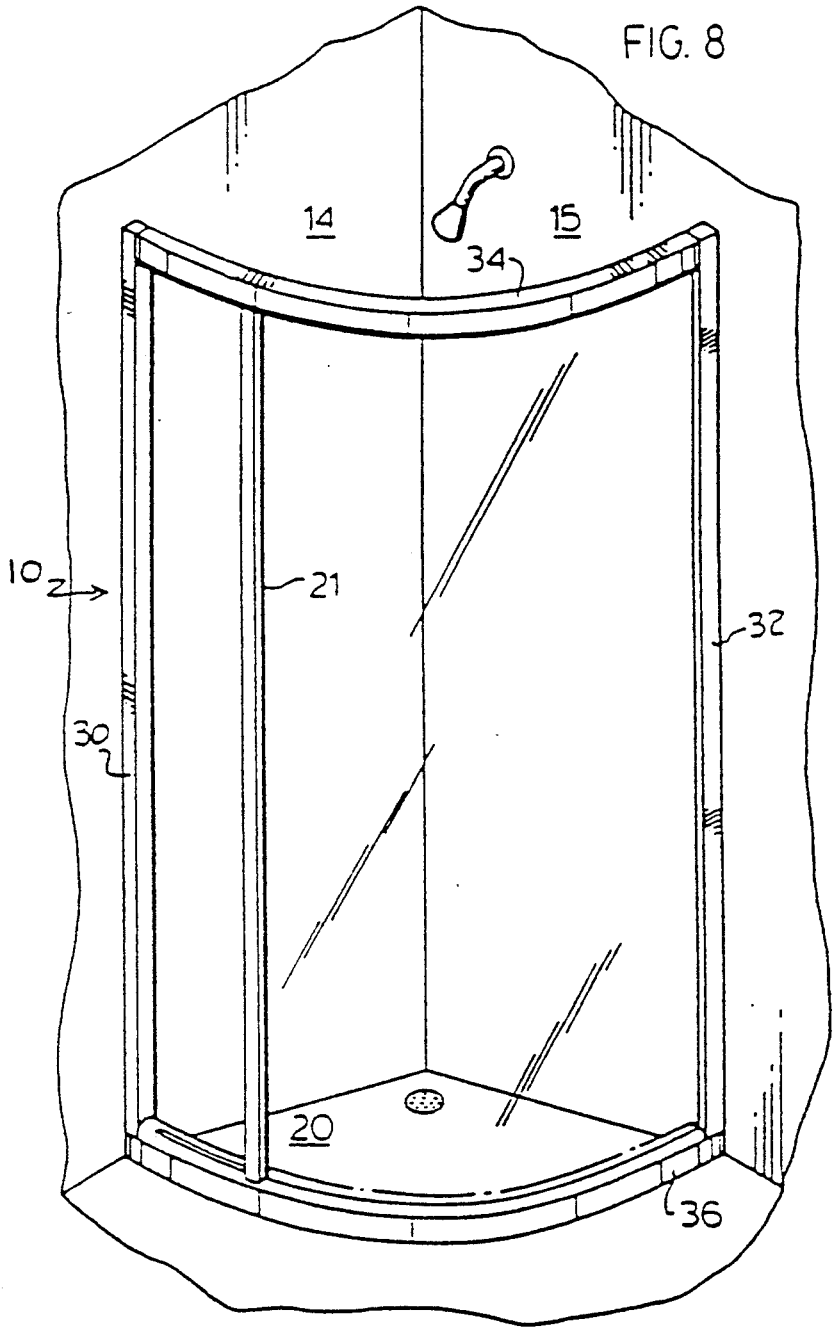
FIG. 8 is a perspective view of a neo-angle shower door assembly comprising a fourth embodiment of the present invention showing the assembly mounted about a shower stall.

Reference is now made to FIG. 8 which shows as a fourth embodiment of the invention, a shower door assembly generally indicated 10 positioned to open and close the access opening of a neo-angle shower otherwise enclosed by side walls 14 and 15.

The door assembly shown in FIG. 8 is substantially identical to that shown in FIG. 1 with the exception that the upper and lower frame and guide channel forming members 34 and 36 have sections which are curved. The flexible extendable door assembly in the present invention is to be appreciated to readily be adapted to extend in upper or lower frame and guide channel forming members which have curved and/or straight sections. In the embodiment of FIG. 8, it is preferred but not necessary that the curvature of the sheet 20 when extended across the shower be in the same direction as the coil 42 tends to wind upon itself.

Figure 10:
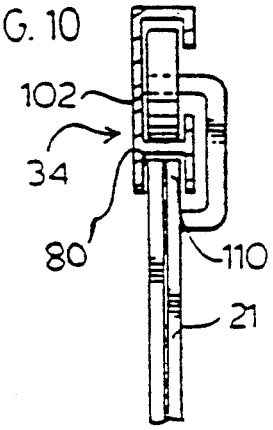
FIG. 10 is a cross-sectional elevational view along line X—X' in FIG. 9.
Figure 9:
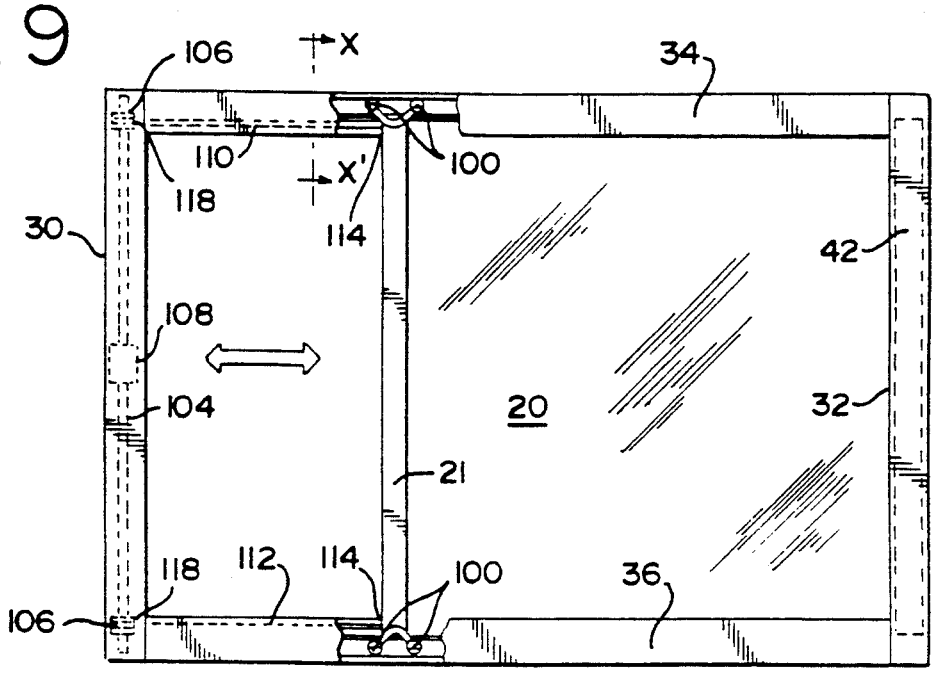
FIG. 9 is a schematic, partially cut-away rear elevation view of a fifth embodiment of the present invention.

Reference is now made to FIGS. 9 and 10 which show a fifth embodiment of a tub or shower door assembly similar in most respects to that of the first embodiment. FIG. 9 shows the assembly as seen from the rear, inside of the shower. The distinctions illustrated in FIG. 9 include firstly, a track and wheel system for guiding the handlebar 21 and, secondly, a separate draw system for reducing the forces required to move the coil towards the extended position.

In FIG. 9, the handlebar 21 carries at each end a pair of guide wheels indicated 100 which are adapted to roll in a guideway 102 provided in each of the upper and lower frame and guide channel forming members 34 and 36. This may be best seen in FIG. 10 with the guideway 102 disposed in this embodiment above the elongate channel 80 of upper channel forming member 34 which receives and guides handlebar 21 and the upper end of sheet 20. While FIG. 10 merely shows the upper frame and guide channel forming member 34, the lower frame and guide forming channel member 36 will have a similar configuration. FIG. 10 shows but one configuration of the guideway and wheels and many other configurations and arrangements of guides and single or multiple wheels or sliders are known to persons skilled in the art.

In FIG. 9, as in FIG. 1, the frame-and-coil locating member 32 locates the spiral coil 42 of the sheet which is extendable towards the left as seen in the rear view of FIG. 9.

FIG. 9 also shows a drawing system for assisting in reducing the forces necessary to draw the sheet 20 to the extended position. This drawing system includes a vertically disposed journalled axle member 104 which carries a spool 106 near either end and a coil spring 108 proximate its center. Thin wires 110 and 112 are coupled at a first end 114 of each to the handlebar 21 and at their second end 118 to their respective spool 106. The axle member 104, spools 106 and coil spring 108 are located within side frame member 30. Axle 104 is journalled inside frame member 30. Coil spring 108 is coupled to frame member 30 and to the axle member 104 such that the coil spring is rotatable to draw the wires 110 and 112 about their respective spools 106 so as to draw the handlebar 21 to the left as seen in FIG. 9 in opposition to the tendency of the coil 42 to draw the handlebar to the right as seen in FIG. 9. Proper selection of the strength of the coil spring 108 compared to the forces by which the coil 42 tends to retract is preferable such that the sheet 20 may be moved to any desired position with only minimal effort yet will retain any desired position between the fully retracted and fully extended positions when released.

While FIG. 9 shows the use of axle member 104 and coil spring 108 to provide a drawing force, other configurations could be developed as, for example, use of a coil spring directly to each spool 106 or the use of a hanging weight with each wire 110 and 112 to pass over pulleys to the hanging weight. By way of further example, coil spring 108 could be replaced by an electric motor, preferably a low voltage DC motor driven by a rechargeable battery with the battery recharged by a solar powered trickle recharger.

Figure 11:
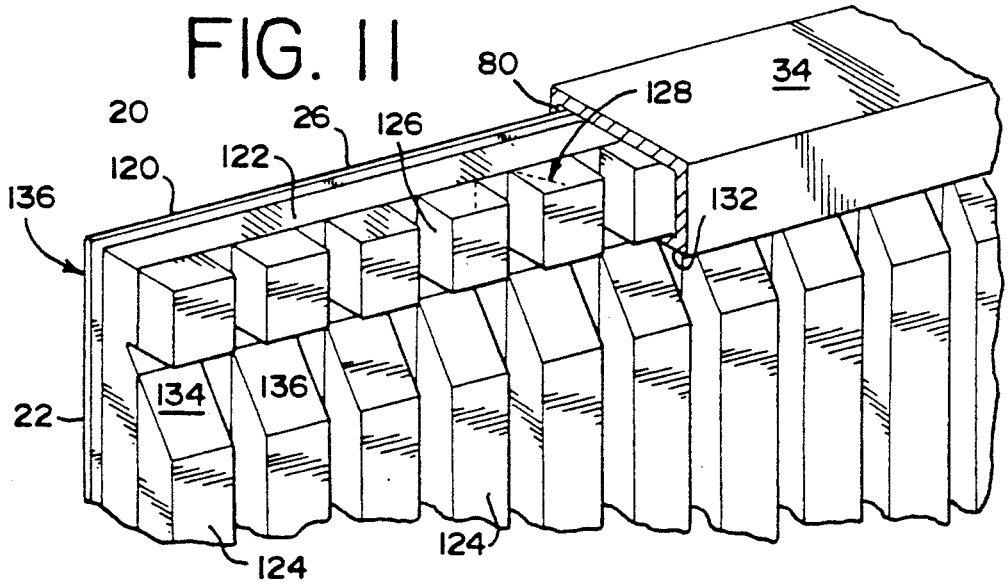
FIG. 11 shows a schematic partially cut-away pictorial view of a flexible retractable door in accordance with the present invention received in a guide channel.

Reference is now made to FIG. 11 which shows an enlarged schematic pictorial view of a composite sheet 20 forming a flexible retractable door in accordance with the present invention. Sheet 20 comprises a sheet 120 of Mylar polyester to which there is secured by means of an adhesive a wood veneer sheet comprising a flexible backing layer 122 and a front layer comprising a plurality of elongated spaced slats 124. Such a wood product is known in the art, for example, as having a tambour construction. Each slat 124 is shown spaced from a neighboring slat by a space 126. This space 126 may be eliminated if the sheet 20 is to be coiled with the Mylar sheet 120 radially inside the veneer laminate, in which case the space 126 may be reduced to a simple slot or cut between the slats 124. If the sheet 20 is to be coiled with the veneer radially inside the Mylar sheet 120, then spaces 126 need to be provided. To facilitate tight rolling, the space 126 may be increased or the edges of the individual slats 124 may be chamferred as, for example, to be cut back to the dotted lines indicated at 128 on two adjacent of the slats.

Surprisingly, it has been found that a composite construction as shown in FIG. 11 need not have the Mylar sheet 120 laminated to the veneer in the sense that there is no need for the Mylar sheet to be bonded to the veneer over the entirety of their surfaces. Rather, it has been found that it is sufficient if they are bonded together merely at the front edge 22 and at the rear edge 24 of the sheet.

FIG. 11 shows the front top edge of the sheet 20 being slideably received in a modified form of the upper frame and guide channel forming member 34. As shown, the veneer laminate, typically of wood, is cut out at 134 so as to provide a downwardly directed shoulder 136 which rests on flange 132 of member 34 so as to assist in bearing the weight of the sheet 20. Having the sheet 20 received so that its Mylar sheet 120 and laminate are retained in the channel 80, can assist in rendering it unnecessary to bond the Mylar sheet 120 to the laminate over the entirety of the sheet.

The sheet construction shown in FIG. 11 is particularly advantageous for use as a door for closing openings other than bathtub and shower enclosures. For example, this embodiment may preferably be used for closing closets and openings generally. Due to the substantial vertical reinforcement and rigidity provided by the slats, it is only necessary to support sheet 20 by an upper frame guide channel forming member 34 and a lower frame and guide forming channel 36 is not necessary. The more rigid composite door 20 of FIG. 11 could be suspended, in effect, merely by a 3 points suspension, the first at the upper front corner indicated 136 in FIG. 11 and then at the upper and lower ends of the coil 42. It is not necessary, therefore, to provide for independent support such as via shoulder 136 along the length of the composite sheet 20 or otherwise.

A drawing system may advantageously be provided in conjunction with the composite door of FIG. 11. When the composite door may be suspended by a simple 3-point suspension as discussed above, a drawing system similar to that illustrated in FIG. 9 may be used, however, preferably with the bottom wire 112 eliminated and the axle member 104 and coil spring 108 reduced in size so as to be disposed immediately about upper spool 106 for upper wire 110. Another simple drawing system may be produced in which a weight is suspended on a wire vertically in side frame member 30, which wire is directed from the vertical to horizontally run, like wire 110 in FIG. 9, within the upper channel 80 by passing over a horizontally axled pulley disposed at a similar location to upper spool 106 in FIG. 9. In the context of closet doors and the like having a typical height which exceeds the width of the opening they close, the weight has ample vertical height for movement.

A particularly preferred closet door arrangement is a composite sheet 20 of FIG. 11 suspended in a 3-point suspension and with a hanging-weight single-wire drawing system. Such a closet door arrangement could have both side frame member 30 and locating member 32 plus upper frame member 34 but would avoid the need for lower frame member 36. While most preferred for closet enclosures, a construction without the lower frame member 36 is also useful in water containment applications, either by providing the door above the tub or shower such that water drains directly into the tub or shower possibly, if necessary, with an additional water dam provided about the edge of the tub or shower such as in a form similar to lower frame member 36 in FIG. 5 albeit without channel 38 formed therein.

The veneer sheet has been shown in FIG. 11 to be of wood, though, however, it may comprise glass, mirror, plastic and combinations of these and other materials.

The veneer sheet has been illustrated as having flexible backing layer 122 comprising slats 124. The flexible backing layer may be eliminated by securing the slats 124 directly to sheet 120 of Mylar. In substitution of the veneer sheet shown, other generally corrugated sheets could be provided with the corrugations providing vertical rigidity yet permitting bonding between the corrugations.

Figure 12:
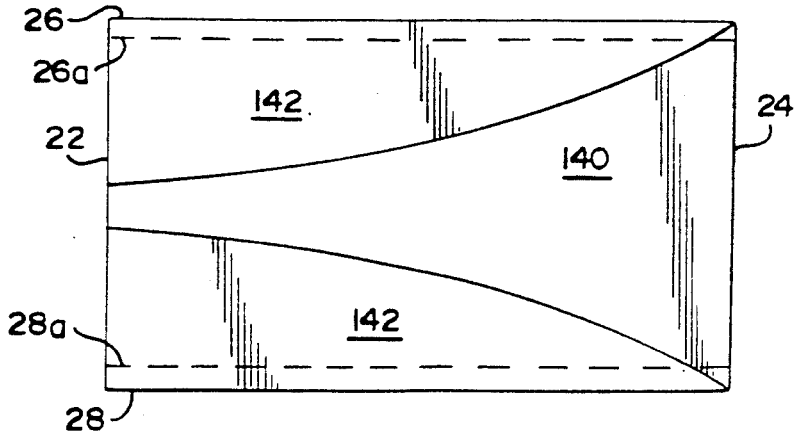
FIG. 12 is a schematic drawing showing a flexible, retractable door in accordance with the present invention in a fully unwound condition.

Reference is now made to FIG. 12 which shows a schematic representation of another form of a sheet totally uncoiled, as it might assume in its manufacture. This sheet is shown as being a composite of a Mylar sheet 140 and another flexible sheet 142. The Mylar sheet 140 having memory is provided so as to not extend the entire height of the sheet near the front edge 22 and is provided of increased vertical height towards the rear edge 24 so that it presents a sufficient area to effectively coil the entire sheet upon itself. This reduces the quantity of Mylar required and, in addition, reduces difficulties regarding edge curl by reason of the Mylar being spaced from the side edges 26 and 28 of the sheet. Selection of the shape of sheet 140 permits the intensity of the coiling force at any point to be controlled and, therefore, the forces required to extend or retract to be controlled as desired. Sheet 142 may comprise any other flexible sheet which may be coupled to the Mylar sheet 140 so as to be coiled thereby. Preferably, sheet 142 may have sufficient vertical rigidity so as to assist in supporting the sheet when in use.

In the context of the sheet 20 shown in the embodiment of FIG. 1, one method of forming the sheet 20 so as to have a permanent coil is to take a rectangular piece of Mylar, roll it into a tight coil and then place it in a heated environment for a period of time. When such a coil is unrolled, the end edges 26 and 28 have a tendency to curl inwardly, that is, toward a median line drawn between edges 26 and 28. One system for avoiding curl is to selectively heat treat the sheet, for example, so as to avoid placing the memory of a coil in the sheet along the edges as, for example, in a space between the top edge 26 and a dotted line indicated **26*a* in FIG. 12 and in a space between the bottom edge 28 and a dotted line indicated 28*a* in FIG. 12. Edge curl may also be avoided by having vertical reinforcing members such as, for example, in FIG. 11**, coupled to the Mylar sheet.

Figure 13A:
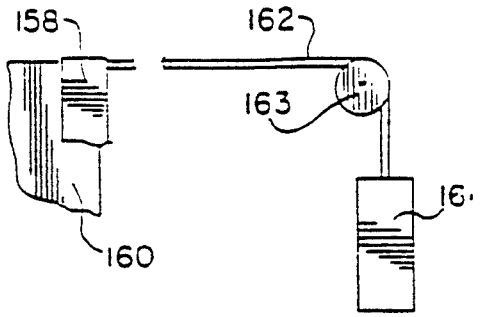
FIG. 13A is a schematic view of a cord and pulley system used with the door of FIG. 13.
Figure 13:
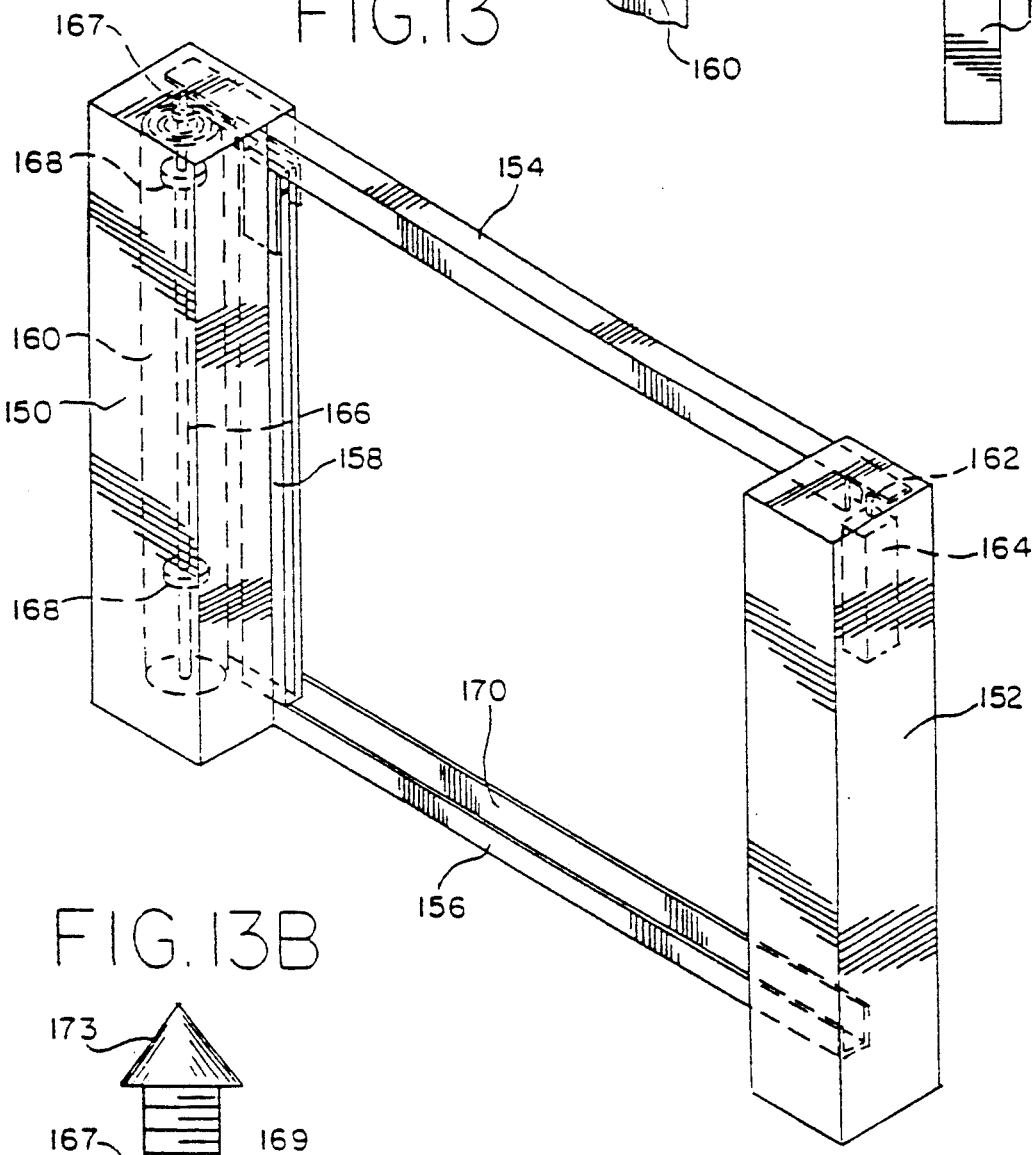

FIGS. 13 and 13A illustrate a variation of a shower door. The assembly illustrated includes upright frame members 150 and 152 and upper and lower U-shaped horizontal frame members 154 and 156. Handlebar 158 for sheet 160 is shown protruding slightly from the enclosure for receiving the coiled sheet which is defined within the upright frame member 150. Cord 162 supports a weight 164 which is received within the upright frame member 152. This cord extends over pulley 163 and extends further along the length of horizontal frame member 154 for attachment at the upper corner of the handlebar 158. The coiled sheet is positioned around axially extending rod 166. This rod supports spaced apart discs 168 which serve as spacers with respect to the coiled sheet.

In the use of the assembly of FIG. 13, the handlebar 158 is grasped and pulled toward the vertical frame member 152. The pulling force applied by the user is augmented by the action of weight 164 whereby the sheet can be very easily uncoiled. By selecting a weight which will be sufficient to offset the maximum recoiling force, the system of FIG. 13 provides a highly efficient means of locating the sheet in fully extended, fully retracted, or partially retracted positions. In addition, if the weight is selected to be close to the recoiling force, then only minor additional effort is required by the user to move the front edge between its various positions. If a "normally-open" condition is desired, the weight is selected so that the coiling force will always tend to place the coil in the retracted position. If a "normally-closed" condition is desired, the weight will be sufficiently larger to provide a force greater than the coiling force so that the extended condition will be automatically achieved unless the sheet is deliberately moved to the retracted position.

The upper and lower horizontal frame members 154 and 156 are U-shaped to serve as guide means for the handlebar 158 and the associated sheet. The bottom frame member includes vertical wall 170 which provides a shield against water splashing outside the shower area.

The spacers 168 provide improved operating characteristics as well as a cost effective means for achieving a large diameter support for the coiled sheet. This feature provides stiffening resistance and improves vertical alignment of the coil and minimizes tendencies toward a vertical curling moment which leads to edge curl. The maintenance of vertical alignment and attendant stiffening resistance permits use of lighter sheet materials thereby saving expense.

The spacers 168 also function to maintain the coiled sheet in a more suitable condition for uncoiling. In particular, these spacers serve to locate the sheet in an offset position relative to the axis of rod 166 (as also shown in FIGS. 2) so that the sheet is fed from this offset position when being moved across the opening defined by the frame members. This offset relationship facilitates feeding of the sheet from the coiled condition along a path offset from the axis of rod 166 which in turn causes the sheet to press against the surface of wall 170 of frame member 156. Specifically, the natural turning moment of the sheet will tend to force the sheet against this surface thereby enhancing the ability to seal the shower enclosure from the area outside the shower.

Figure 13B:
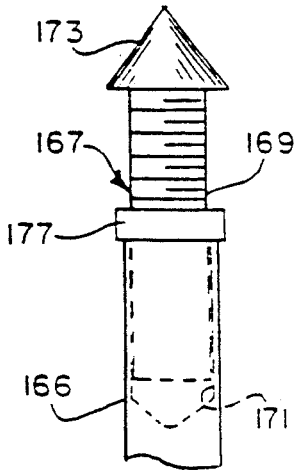
FIG. 13B is a detail view of the adjustable upper end of the rod used for supporting the coiled sheet of FIG. 13.

FIG. 13B illustrates in detail the upper end of rod 166 which includes adjustable pivot pin 167. This pin defines a threaded shaft 169 receivable in bore 171 defined by the rod. The cone-shaped end 173 of the pin is adapted for engagement with a complementary seat in the top wall 175 of frame member 150, and nut 177 is used to fix the pin in position once the desired seated relationship is achieved. With this arrangement, the rod 166 can be held in a fixed location within the frame member, and is easily installed during assembly of the frame members, guide means, etc.

Figure 14:
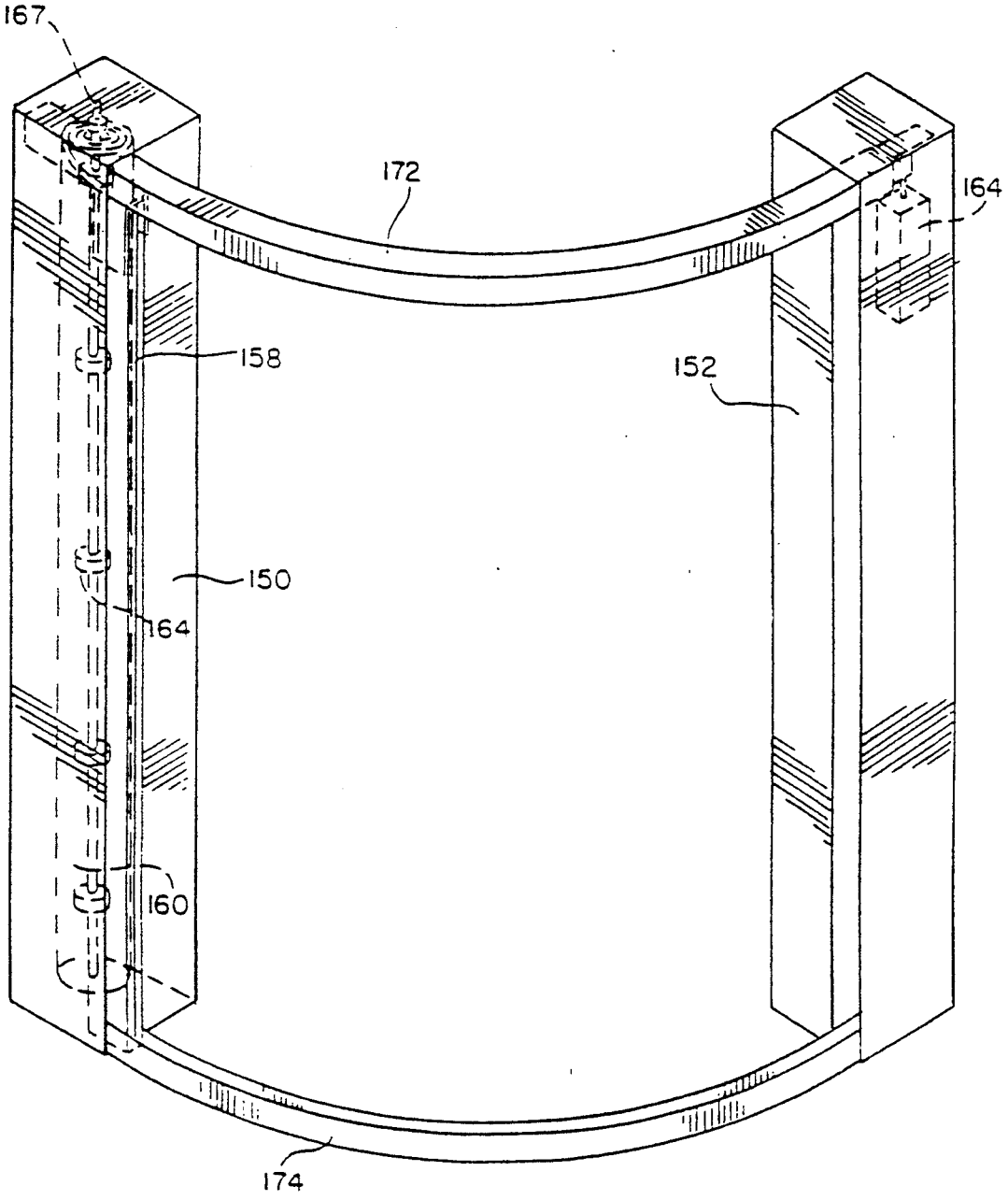
FIG. 14 is a schematic view of a variation of the invention illustrating the application of the concepts of FIG. 12 to a neo-angle shower door.

FIG. 14 illustrates another alternative for application of the invention to a shower enclosure. In this instance, the respective upper and lower frame members 172 and 174 are curved. Both of these frame members are preferably of U-shaped configuration to confine both the upper and lower edges of the sheet when the sheet has been extended. This is particularly desirable for purposes of resisting any tendency of the sheet to pull away from the arc defined by the frame members and into the shower enclosure.

Figure 15:
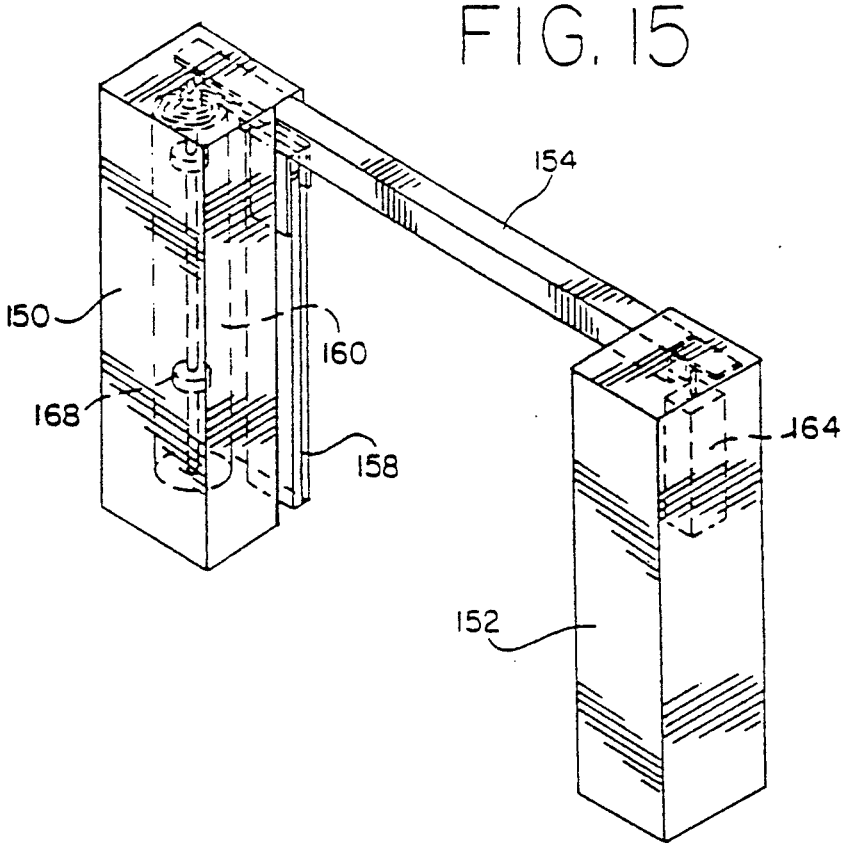
FIG. 15 is a schematic view of a variation of the invention applied to a cabinet door or the like with the door in the open position.
Figure 16:
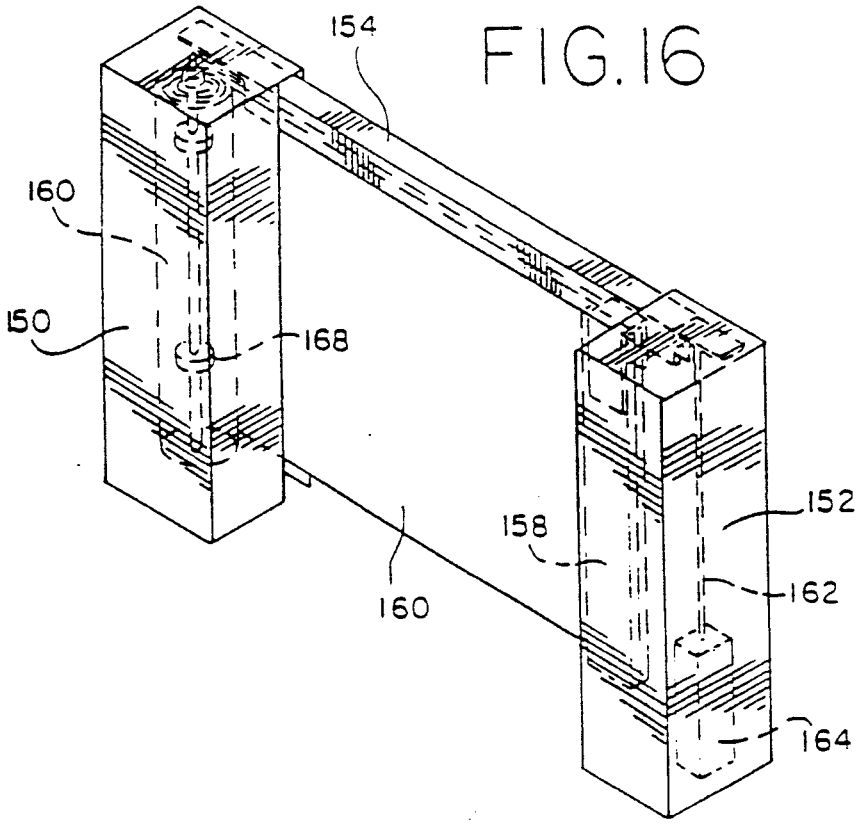
FIG. 16 is a schematic view of the door of FIG. 15 shown in the closed position.

FIGS. 15 and 16 illustrate application of the invention in the form shown in FIG. 13 to a cabinet door or the like. In this instance, it will be noted that no provision is made for a lower frame member.

Figure 17:
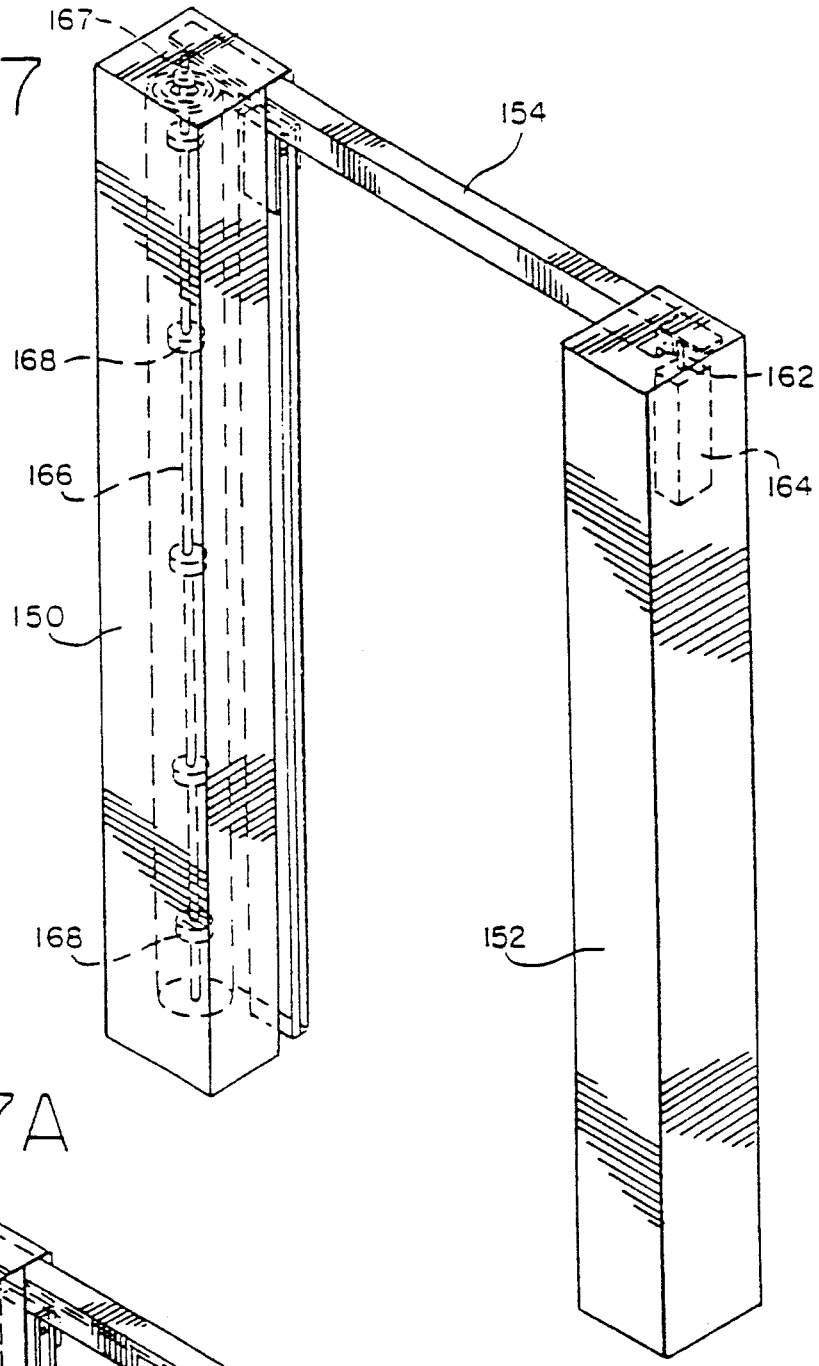

FIG. 17 also illustrates components which essentially correspond with the components of FIG. 13. In this case, the vertical frame members 150 and 152 are extended to provide sufficient height for a closet door or the like. In order to accommodate this greater vertical extent, additional spacer discs 168 are employed.

Figure 17A:
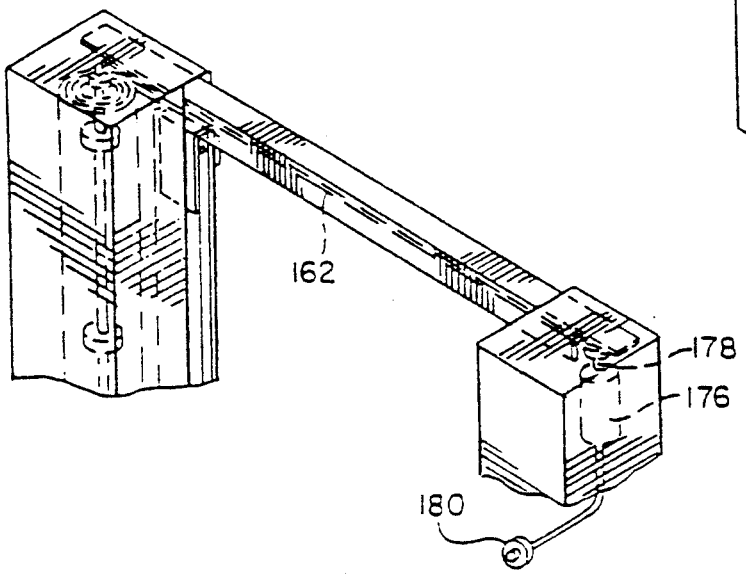
FIG. 17A is a detail view of the door of FIG. 17 including a motor drive feature.

FIG. 17A illustrates a possible modification of the arrangement shown in FIGS. 15–17 wherein a motor 176 is attached to vertical shaft 178. Cord 162 in this instance is connected to the shaft 178 instead of to a weight 164. By mounting the motor and shaft arrangement in the enclosed space of vertical support 152, the driving force of the motor will serve to overcome the recoiling force of the sheet while rolling the cord around the shaft whereby the sheet can be moved to the closed position by pushing the start button 180 for the motor. The driving force of the motor may be augmented by manual assistance.

The use of the motor is particularly desirable where a larger size installation is involved. Start button 180 can be readily mounted on the frame member 152, or infrared control or the like is possible. A very low power motor is all that is required, for example battery powered types used for power tools, or various well known pneumatic or hydraulic arrangements. It will be understood that the provision of a motor as shown in FIG. 17A, as well as the provision of a weight of the type shown in FIGS. 13 through 17, would be applicable to the various embodiments described in this application.

It will also be appreciated that the use of a motor may be advantageously combined with the use of a weight as shown in FIG. 17. Thus, the shaft 178 of motor 176 may be used to drive pulley 163 with the cord 162 preferably looped around the pulley. Rotation of the motor will affect the balance between the coiling force and the weight and the weight will provide take-up of the cord.

Figure 18:
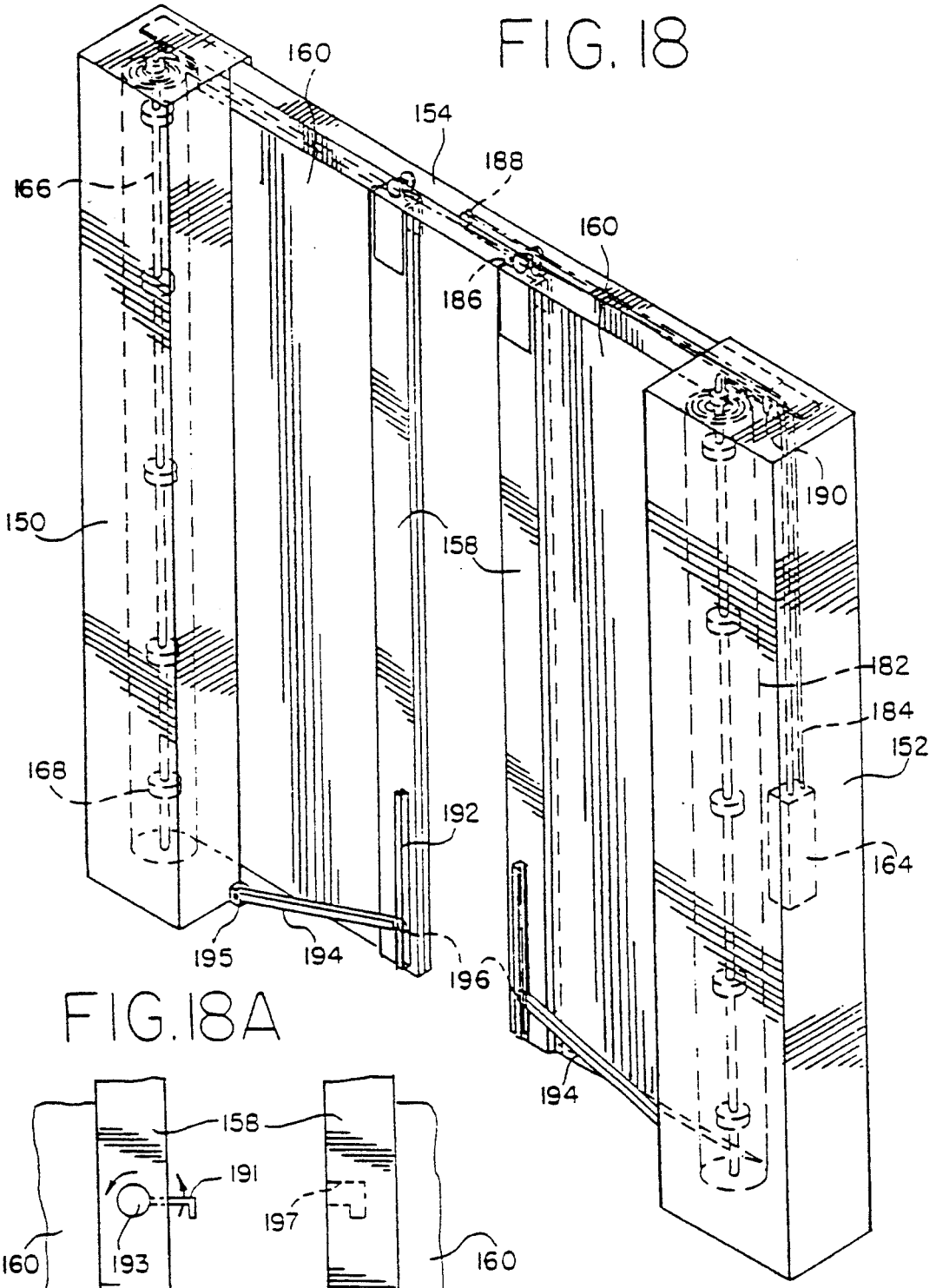
FIG. 18 is a schematic view of a variation of the invention applied to a double closet door configuration.

FIG. 18 provides another example of a larger type installation. One contemplated application would be for a closet door, but these larger type installations are also applicable to doors dividing one inside living space from another or an inside space from an outside space.

The installation of FIG. 18 involves the use of a pair of doors with the respective handlebars 158 being movable toward each other during closing and away from each other during opening. In this instance, sheets 160 are adapted to assume a coiled configuration in respective vertical frame enclosures 150 and 152 located on opposite sides of the opening. A single top horizontal frame member 154 is employed. This arrangement is characterized by first and second cords for assisting in the control of the movement of the respective sheets. The cord 182 is attached to the handlebar 158 of the left-hand sheet, and this cord functions in conjunction with the weight 164 and pulley 190 in the manner described with respect to FIGS. 13 and 13A. In this instance, however, the limit of movement of the front edge is approximately a vertical line located midway between the vertical frame members 150.

A second cord 184 is connected at 186 to the front edge 158 of the right-hand sheet 160. This second cord extends over centrally-mounted pulley 188 and then back in the direction of pulley 190. The pulley 190 supports both cords, and both cords are connected to weight 164.

The arrangement of FIG. 18 also includes means for assisting in the positioning of the bottom portions of the respective handlebars 158. In each instance, a vertical channel-shaped guide member 192 is attached to the inside face of each handlebar. Pivotal bars 194 support rollers 196 which are movable within the respective channels. The bars 194 are dimensioned so that they maintain the handlebars 158 in a substantially vertical position as these handlebars move back and forth. This also has the effect of keeping the bottom areas of sheets 160 taut to avoid any tendency towards curling in this area. In that connection, the weight of the bars may be sufficient to press the rollers against the guide members, although spring assists could be located at pivots 195 for that purpose. The bars 194 are not intended to reach the horizontal so that they will pivot upwardly upon sheet retraction.

Figure 18A:
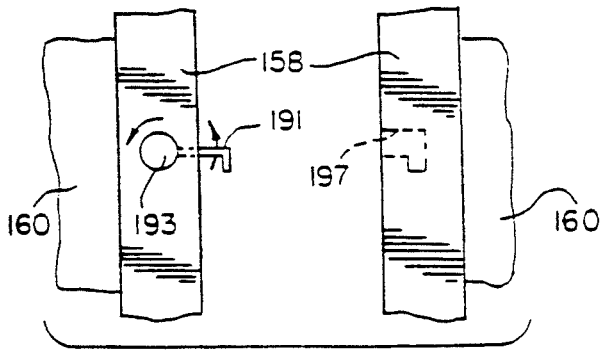
FIG. 18A is an enlarged fragmentary view of a latch means usable with the embodiment of FIG. 18.

FIG. 18A illustrates a simple latch structure which may be employed for holding the respective handlebars 158 together. Hook element 191 is adapted to pivot upwardly in response to rotation of knob 93 mounted on one handlebar 158. Recess 197 is defined in the other handle bar for receiving the end of the hook. This same system may be used to latch a handlebar to a stationary frame such as the frame 218 of FIG. 20. Magnetic latch means as well as numerous other latch and/or lock systems are also adaptable for use with the various embodiments of the invention.

Figure 19:
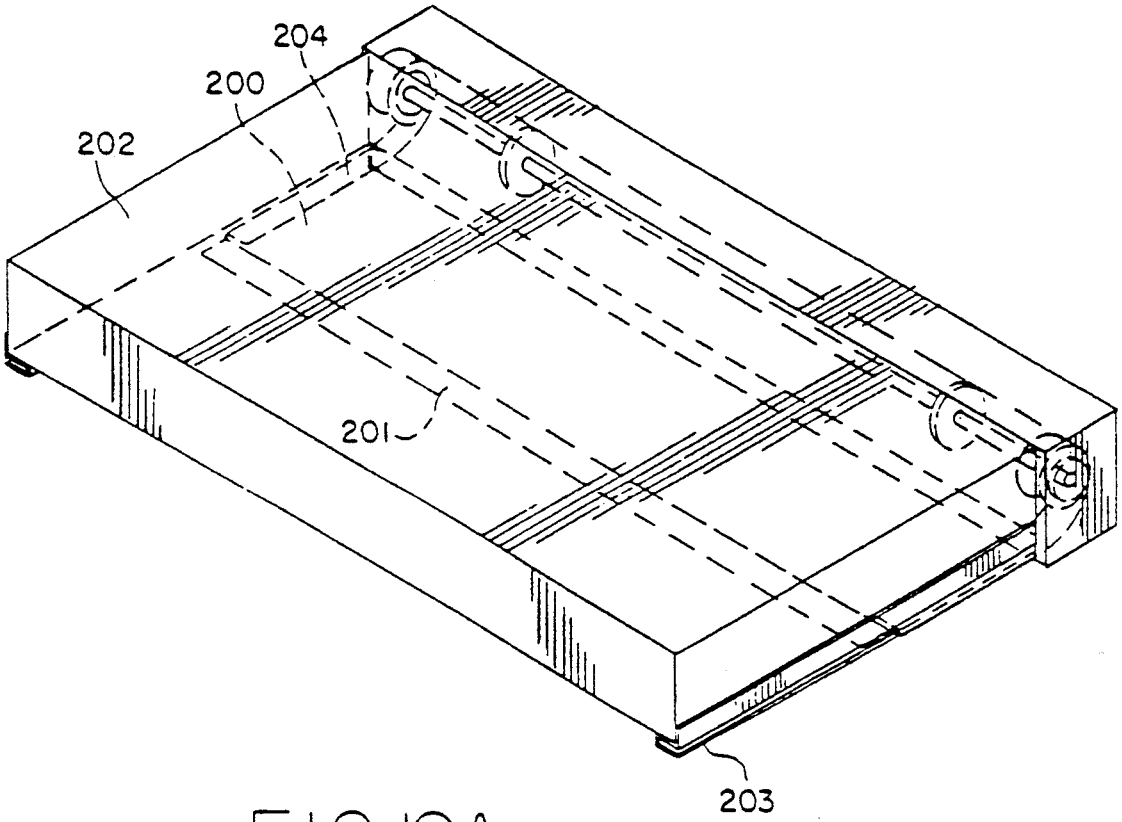
FIG. 19 is a schematic view of a variation of the invention applied to a fluorescent light cover.

FIG. 19 illustrates an application of the invention wherein the sheet 200 is movable in a horizontal path with respect to an opening defined by the box-shaped housing 202. One application for an arrangement of this type involves a housing for fluorescent lighting with the sheet 200 providing the desired translucent cover for the housing while at the same time being easily movable to an open position for bulb replacement. A suitable latch may be associated with handlebar 201, and the housing 202 to hold the sheet in the extended position. It will be appreciated that by using a simple latch operable with one hand, a person standing on a ladder could hold replacement bulbs since the sheet will automatically retract when the latch is released.

The sheet of FIG. 19 is provided with side edges 204 which are folded over thereby providing reinforcement at the edges to increase the useful life. It has also been found that a folded over edge as illustrated provides an effective means for avoiding "edge curl" in a sheet having self-coiling characteristics since the thicker edge may be located in a guide as shown in FIG. 5 and there will then be minimal opportunity for any curling. An edge approximately one inch in width is suitable for achieving this benefit.

Edge curl elimination for the embodiment of FIG. 19 as well as other embodiments is also possible with the use of preferential heating in connection with the same areas shown occupied by the fold-over edges 204. Specifically, and with or without the folded-over edges, such edge areas could be selectively reheated to remove memory after the self-coiling characteristics are induced in the sheet.

Figure 19A:
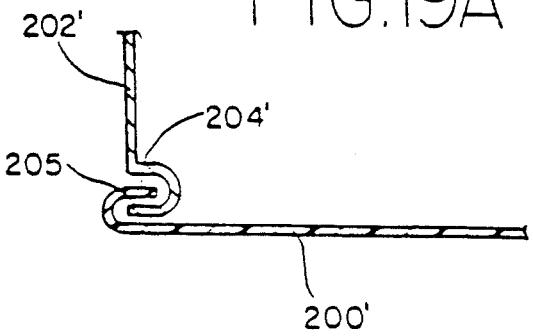
FIG. 19A is an enlarged fragmentary sectional view illustrating a variation of the embodiment of FIG. 19.

In the embodiment of FIG. 19, the side edges of sheet 200 ride on and are supported by the top surface of L-shaped angle members 203 attached to each side wall of housing 202. FIG. 19A illustrates a variation of the embodiment of FIG. 19 wherein the sheet 200' is associated with housing 202'. In this case, the lower side edges of the housing each define a lip 205 which receives the folded-over portion 204' of the sheet 200'. In other words, these portions are formed with spaces defined between them and the main body of sheet 200' whereby the lips 205 will provide support and a guide means for the sheet while also holding the sheet sufficiently to avoid any significant edge curl. As with other features described herein, the concept of the folded edge and lip combination is adaptable to the various embodiments of the invention.

Where a self-coiling sheet is used for a lighting fixture such as shown in FIG. 19, or for any other application where some light is to be transmitted, the sheet surface may be painted, laminated, or otherwise processed to provide diffraction or for some other functional or aesthetic reason. Mylar is an example of a material which lends itself readily to such surface treatment.

FIG. 19 also serves to demonstrate that the concepts of the invention are applicable to doors or other covers which are disposed in other than a vertical configuration. Other readily forseeable applications of this type include attic access doors, emergency supply kits, and swimming pool covers.

As indicated, any box-like or other arrangement for which a cover is required provides a possible application for the concepts of this invention. Thus, these concepts involve simple, inexpensive constructions, unbreakable or fracture-resistant covers, and they are space efficient and suitable for various orientations.

Figure 20:
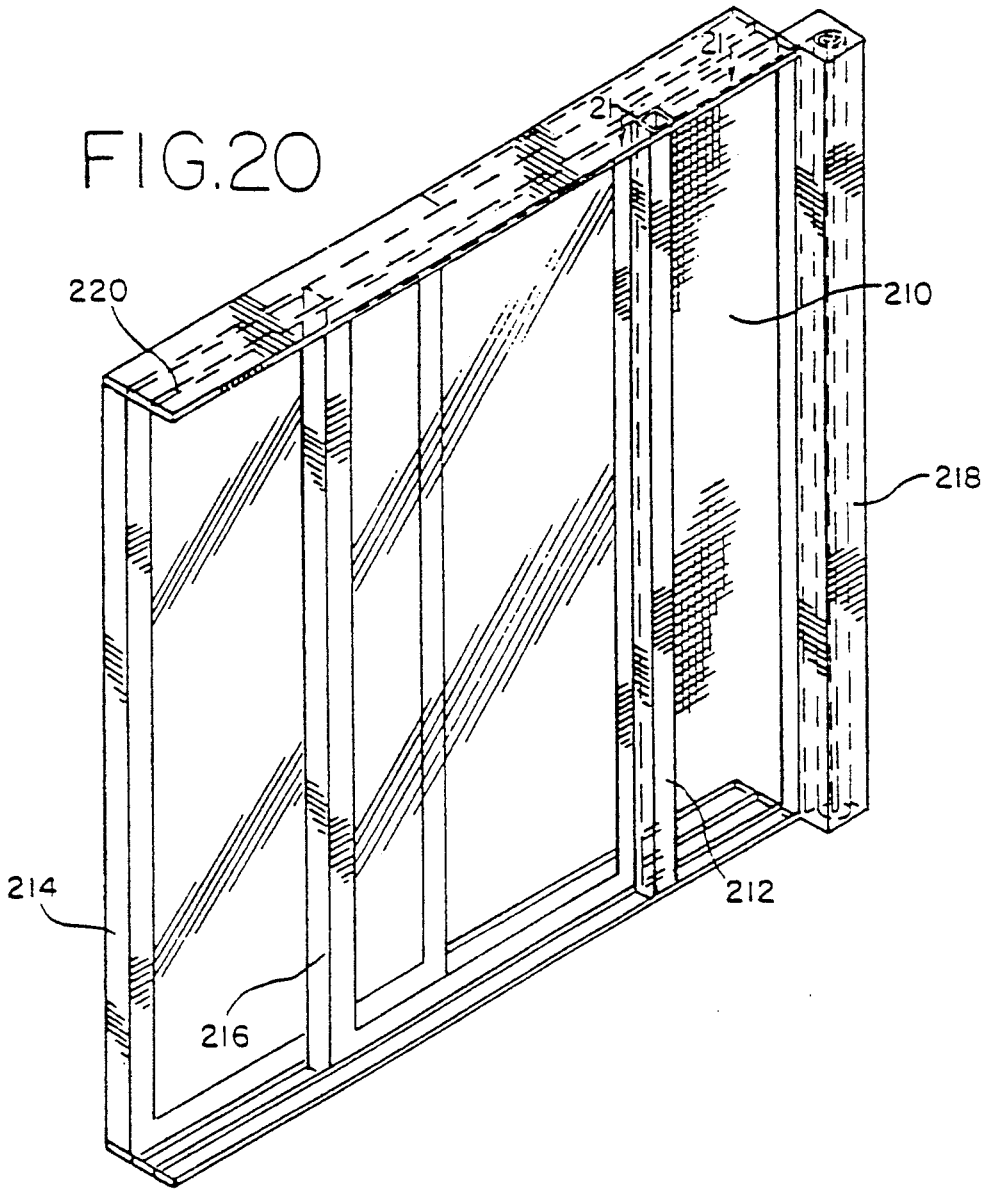
FIG. 20 is a schematic view of a variation of the invention applied to a screen door.
Figure 21:
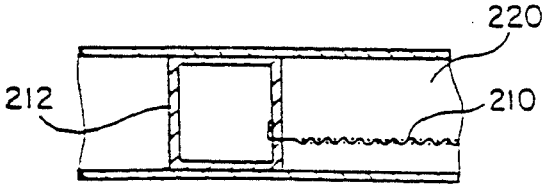
FIG. 21 is an enlarged fragmentary view of a portion of screen of the type used in the embodiment of FIG. 20 taken about the line 21—21 of FIG. 20.

An embodiment of the invention shown in FIGS. 20 and 21 is particularly suitable as a substitute for conventional sliding screen doors. In that connection, materials including polyester terephthalate sold under the trade names Terylene, Fortrel or Dacron are adapted to be woven or otherwise processed to achieve a perforated configuration. In particular, such materials have been produced in sheet configurations of the type shown in FIG. 21 for use as screens which permit passage of air but which provide a barrier to entry of bugs, etc. It has been found that self-coiling characteristics can be imparted to such materials and, therefore, the concepts of this invention extend to such materials.

FIGS. 20 and 21 illustrate in particular a screen 210 which is provided with a handlebar 212. This screen is shown in conjunction with a first sliding window 213 and surrounding frame 214 and a second sliding window 215 and frame 216. The frames are intended to slide in upper and lower rail guides 217 and 219 in conventional fashion. One of these sliding glass doors is shown in the partially opened position, thereby leaving a space which is occupied by the sheet 210. This sheet has been uncoiled from the enclosure 218 which supports the coiled sheet in the manner described with respect to other embodiments. A top rail 220 and bottom rail 221 serve as upper and lower guides for the handlebar, and it will be apparent that the sheet may be extended to any position depending upon the extent to which the sliding doors 214 and 216 have been opened.

The arrangement of FIG. 20 is of particular value when compared with conventional sliding door and screen arrangements. Screens for such doors are typically enclosed in a rigid frame which must be removed, for example in the wintertime, when the frame is not in use, in order to take full advantage of the glass windows and doors. If the frame and screen are left in place, the screen will block approximately half the glass at all times. With the arrangement of this invention wherein the screen is coiled out of sight in a frame member when not in use, a superior combination is realized.

The screen fragment shown in FIG. 21 is a woven material, and it has been found that this structure has the effect of substantially eliminating edge curl because there is no path for passing the coil memory to a vertical direction. It is contemplated by this invention that more tightly woven or heavier gauge polyester be substituted for the solid sheet material described with respect to other applications so that the benefits of a barrier, for example against passage of water or light, would be available without encountering an edge curl problem. It is also contemplated that the weave be a composite of "memory-capable" polyester in the horizontal direction and "non-memory" material (such as aluminum, steel or phenolic fibres) in the vertical direction. This insures that there be no path for memory in the vertical direction thereby eliminating the edge curl and reducing cost.

Figure 22:
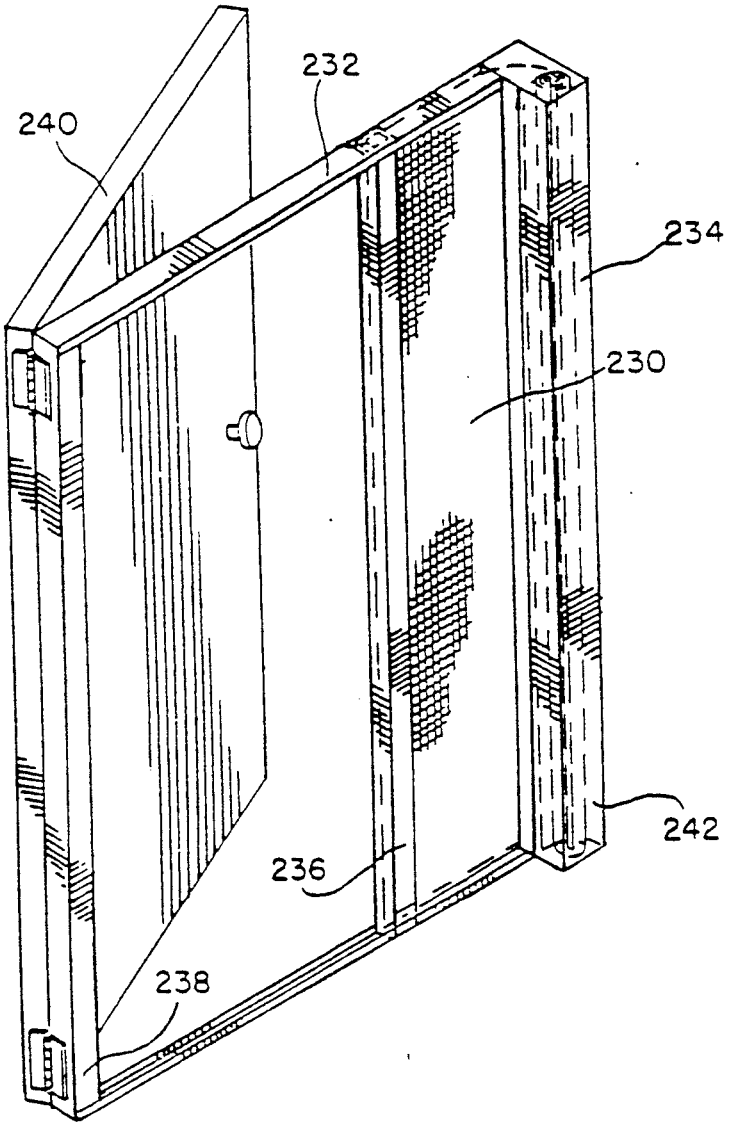
FIG. 22 is a schematic view of a variation of the invention applied to a screen configuration used in conjunction with a hinged closure.

FIG. 22 illustrates a form of the invention wherein a screen 230 is mounted in a frame including right-hand vertically extending section 234 which serves as the enclosure for receiving the coiled screen 230 when the screen is in the retracted position. The handlebar structure 236 is provided for the screen to move the screen across the opening defined by the frame, and any suitable latching means could be employed for holding the handlebar in position relative to the opposite vertical frame section 238.

The frame section 238 is also used for supporting a hinged door 240, this door being movable back and forth between open and closed positions in the manner, for example, of a door used for access to a home or porch. A hinged or vertically sliding window could also be involved in this particular application. It will also be appreciated that the frame including vertical members 234 and 238 and horizontal structure 232 could itself be hinged to a jamb or the like to provide a hinged screen door or window, and the door (or window) 240 could be of a sliding type as well as hinged. Movement of the screen may be vertical or horizontal, and/or along a curved path as, for example, in the case of a bay window.

In applications such as shown in FIGS. 22, long periods may go by when there is no occasion for leaving the door open and for use of a screen, and in such circumstances, the screen will be stored in the enclosure comprising frame section 234. When it is desired to keep the door or window ajar, the screen can be readily moved into the closed position. This arrangement has obvious advantages over a typical screen door or window which is either kept permanently in place or removed depending upon seasonal changes. It will be appreciated, of course, that instead of the screen 230, a self-coiling solid sheet could be located within the frame to serve in the capacity of a storm door or window. The front panel 242 of frame section 234 could also comprise a removable access panel which could be used for switching between a screen and solid sheet. Alternatively, a solid sheet could be stored in the frame section 234 on one side and a screen in the frame section 238 on the other side for selective use.

Figure 25:
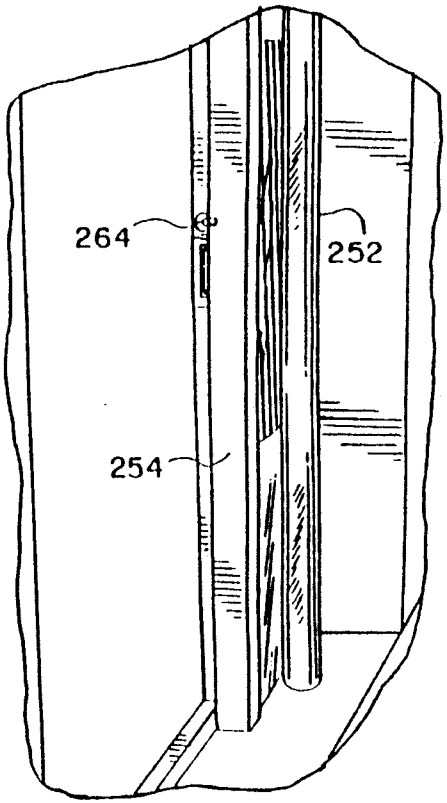
FIG. 25 is a rear elevational view of the door of FIG. 23 in the fully-opened position.
Figure 24:
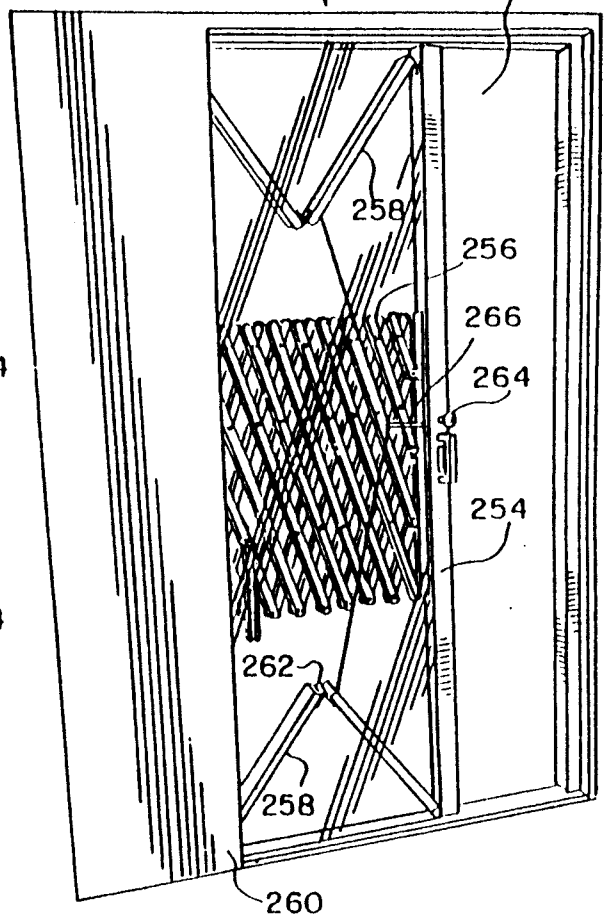
FIG. 24 is a front elevational view of the sliding door of FIG. 23 in the partially-opened position.
Figure 23:
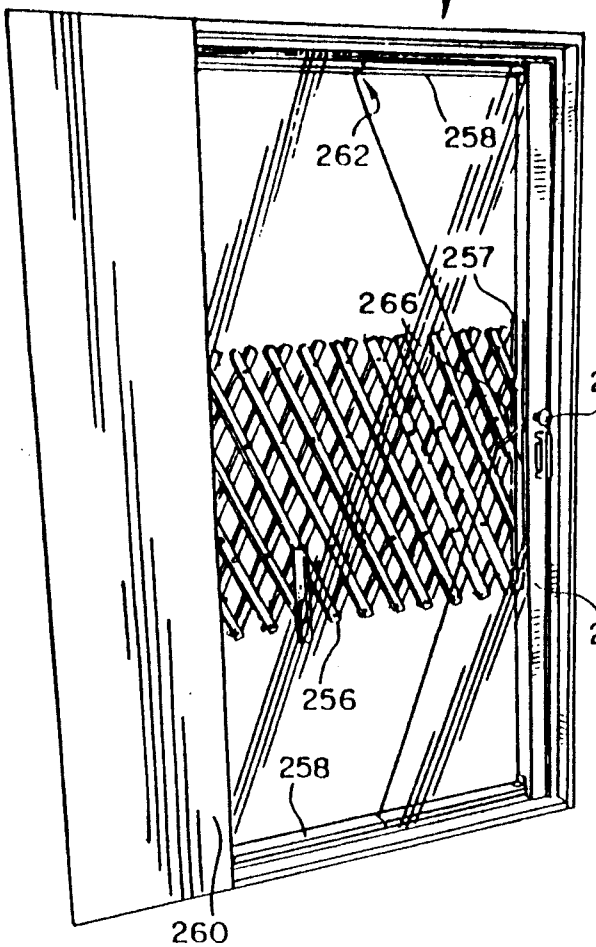
FIG. 23 is a front elevational view of a variation of the invention applied to a sliding door shown in the closed position.

FIGS. 23 through 25 illustrate an arrangement wherein the concepts of the invention are applied to the door 250 which may be used to block a passageway into a home or other building or for controlling access within a building. The door consists of a combination of self-coiling sheet 252 having handlebar member 254 to permit back and forth manual movement. Located immediately behind sheet 252, there is provided an expanding lattice structure 256. This lattice structure has one vertical end piece 257 attached to handlebar 254 and an opposite vertical end piece (not shown) attached to side frame member 260. As will be apparent, this structure serves as a backing for sheet 252 and adds substantial structural integrity to the door while at the same time being collapsible so that, along with the self-coiling sheet 252, a compact arrangement is achieved when the sheet is in the fully open position as shown in FIG. 25.

The arrangement shown here also may be used as a machinery guard or the like wherein the sheet 252 is transparent. This permits viewing of a machine with the sheet extended for protection, and an interlock may be added to insure that the machine will be shut down when the operator needs to retract the screen and put hands inside.

The arrangement shown in FIGS. 23-25 further includes an assembly of arms 258. One arm is pivotally mounted at one end to the handlebar 254, and the other arm is pivotally mounted to the side frame member 260. The opposite ends of the arms in this assembly are hinged to each other at 262. As the door structure is moved to a fully closed or extended position, the arms 258 are gradually moved to a substantially horizontal position. This results in an effective means for holding the door in the closed position since the arms become locked against pivoting away from the horizontal position when merely subjected to horizontal forces as would be the case if someone attempted to open the door by use of handlebar 254.

Figure 25A:
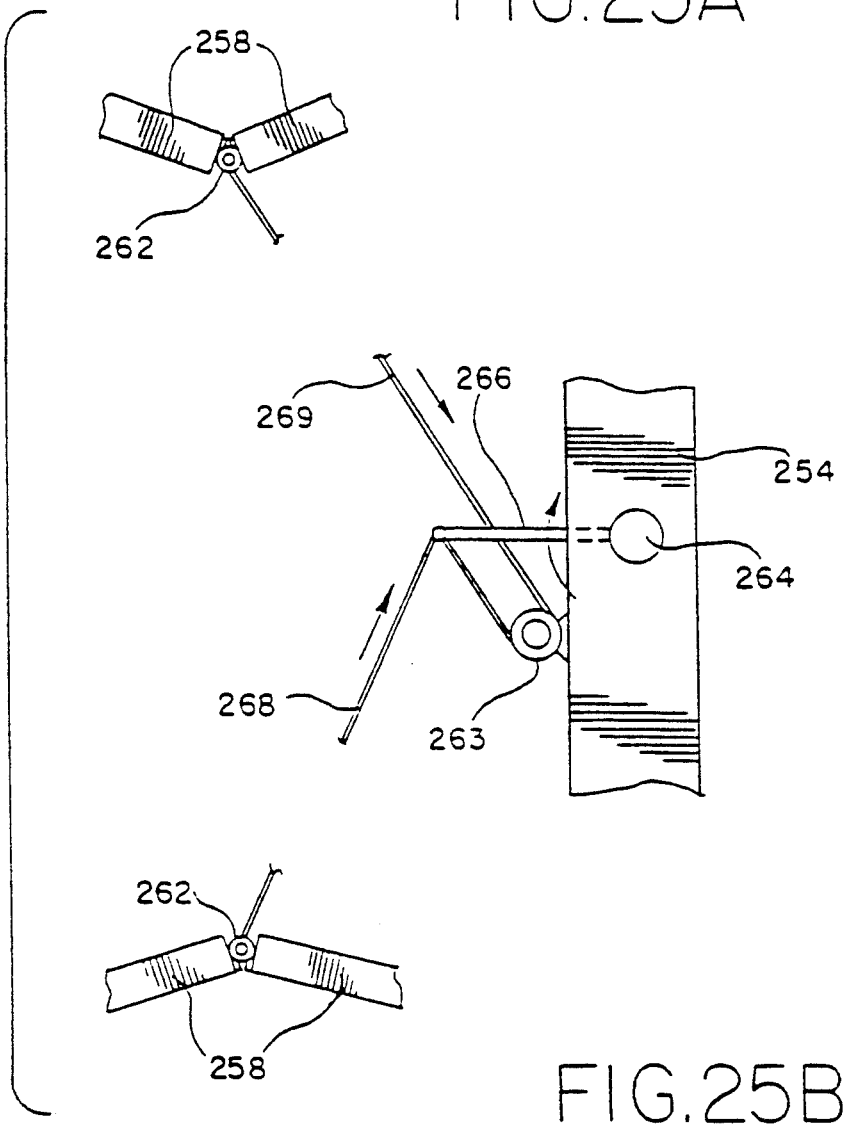
FIG. 25A is a fragmentary detail view of a control arrangement for pivoting arms used in conjunction with the embodiment of FIGS. 23–25.

As shown in FIG. 25A, a rotating handle 264 is provided for unlocking the arms 258 to permit opening of the door. This handle operates a pivoting arm 266, shown located between transparent sheet 252 and lattice structure 256, which has wires 268 and 269 attached at its end. A pulley 263 is attached to handlebar 254, and wire 269 is looped around this pulley and then connected to arm 266. These wires extend to the respective pivot junctions 262 of the arms 258 and, as will be apparent, rotation of the handle 264 will apply tension to both wires when the arms 258 are in the horizontal position. This will result in pivoting of the respective arms away from the locked position whereby the application of horizontal force to the handlebar 254 will permit opening of the door.

Figure 25B:
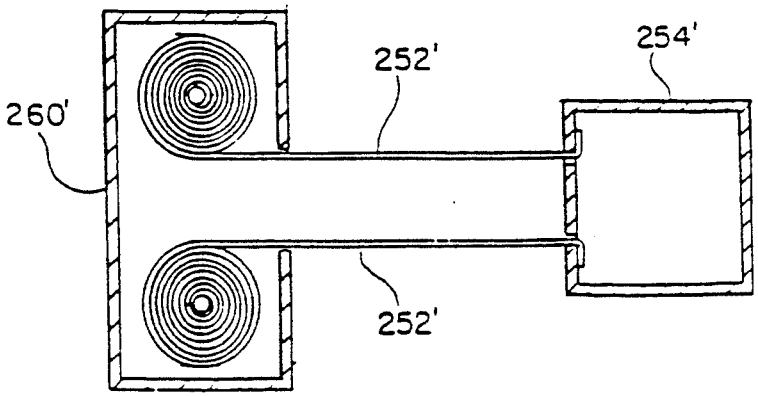
FIG. 25B is a vertical sectional view illustrating an application involving a double side sheet configuration.

The door 250 is readily adapted to the addition of facings on one or both sides which will hide the internal operating parts. FIG. 25B illustrates schematically how this may be accomplished by using separate sheets 252' supported in side frame member 260'. The sheets are extendable and retractable using handlebar 254'. For clarity, the lattice work or other interior reinforcement is removed, and it will be understood that this embodiment may be used without such reinforcement.

Both sheets of Mylar or other material may have memory, and one or both sheets may be laminated to a wood-like veneer material or other material to give the appearance of a wooden sliding door or some other standard appearance. Similarly, a more common door handle may be used in place of the handlebar, and the frame member 260' may be constructed on one or both sides to give the appearance of a standard door frame. In that case, the frame may extend over the top and down the other side where a latch may be provided to hold the door in the extended position.

Figure 28:
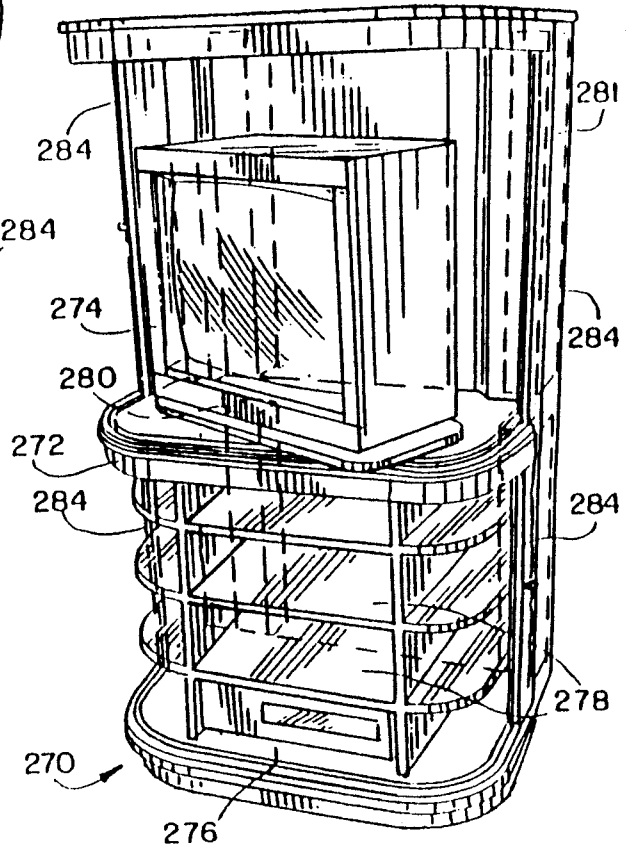
FIG. 28 is a view of the center of FIG. 27 with the lower section in the partially opened position.
Figure 27:
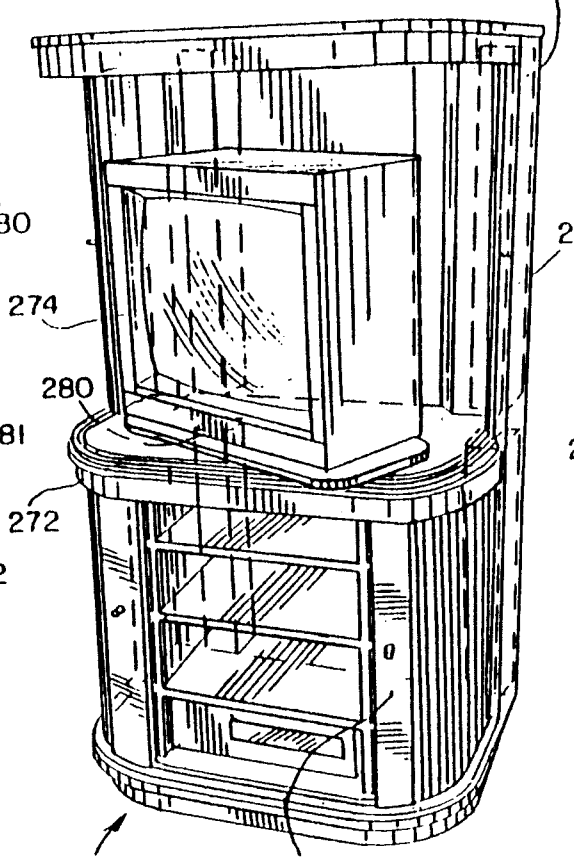
FIG. 27 is a view of the center of FIG. 26 with the upper section in the fully-opened position.
Figure 26:
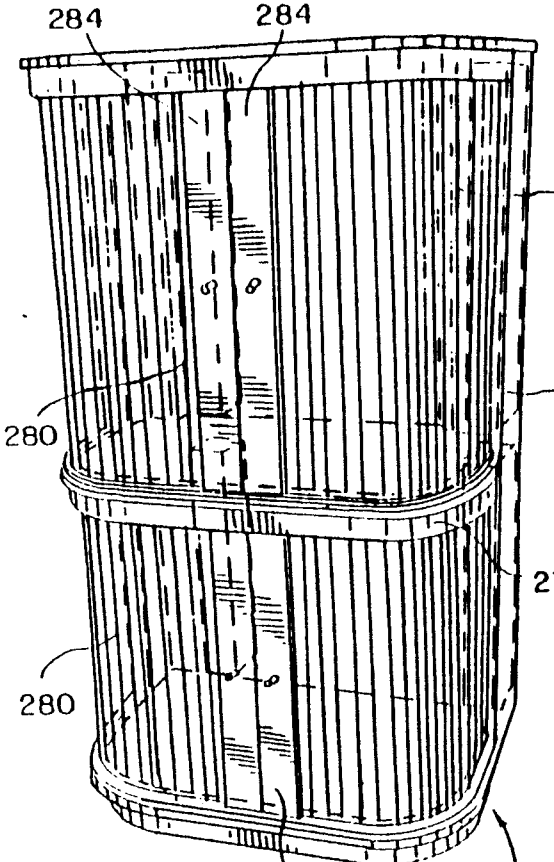
FIG. 26 is a perspective view of a variation of the invention applied to an entertainment center.

FIGS. 26 through 28 illustrate the application of the invention to an entertainment center 270. This structure includes an intermediate table 272 which may support a television set 274. A lower section of the center includes bottom wall 276 for supporting, for example, a video cassette recorder, and intermediate shelves 278 may be employed for holding cassettes or for other structures such as tape decks, CD players, etc.

The upper section of the entertainment center includes a pair of movable enclosing walls 280 which are particularly characterized by the features of this invention. In the preferred form, these walls utilize a self-coiling sheet having a tambour arrangement such as shown in FIG. 11 secured on the exterior surface of the sheet. In the tambour arrangement of FIG. 11, the slats 124 are mounted on a flexible backing layer 122 which is, in turn, attached to the self-coiling sheet 120. This arrangement is applicable to the entertainment center 270; however, it is also contemplated that slats providing the tambour-effect will be attached directly to a self-coiling sheet as will be described in more detail with reference to FIG. 41.

The movable walls 280 are shown in the open position in FIGS. 27 and 28. The housing of the entertainment center is designed so that substantial enclosing space for the coiled wall 280 is provided at the back of the center in the area 281 so that the coiled wall can be maintained substantially out of sight, for example in the manner shown with respect to the enclosure 32 of FIG. 2. Thus, only the handlebars 284 need be visible and this provides a particularly satisfactory aesthetic advantage.

Separate walls 280 provide the means for enclosing the lower section of the entertainment center. In this instance, the walls may be opened to an intermediate position as shown in FIG. 28 or completely opened as shown for the upper section of the center. Features shown in other drawings such as upper and lower tracks for the self-coiling walls and which relate to means for maintaining such walls in any of several intermediate positions are applicable to a center such as shown in FIGS. 26 through 28.

It should be understood that references herein to "tambour" are not intended to describe any particular structure but instead apply to any stiffening means of a variety of materials. The illustration of a design similar to that used for a "roll top" desk is only one example of a stiffening means applicable to a self-coiling sheet wherein the character of the stiffening means is such that they are capable of formation into a coil with the sheet. It should also be clear that such stiffening means are applicable to both sides of a sheet, for example in connection with the door of FIGS. 23Δ25.

The attachment of stiffening means could be accomplished, as described, by locating the slats or the like on a backing and attaching the backing to the self-coiling sheet. The attachment could be at only the top, front and back edges. Alternatively, the slats or other stiffeners could be attached directly onto the sheet, for example, at the top and bottom of each slat. If steel or other magnetic material is used for the slats, magnetism could be used for adhesion since metallic coatings, including coating with magnetic properties, are readily applied to Mylar.

Figure 29:
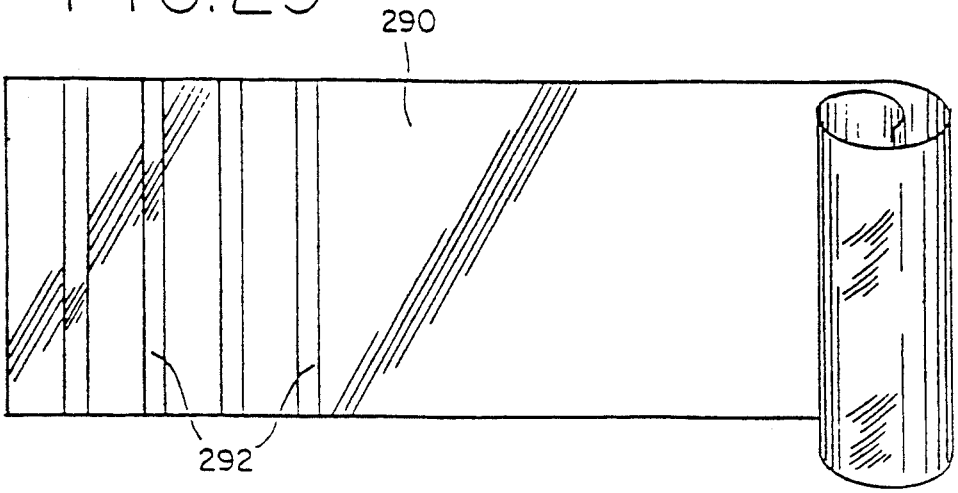
FIG. 29 is a schematic view of a sheet having partial memory set and areas without memory set.

FIG. 29 illustrates a self-coiling sheet 290 which has been selectively heat treated. As previously noted, the memory for achieving self-coiling capability in a Mylar or similar sheet is accomplished by heat treatment of the sheet. The memory may be included substantially completely throughout the sheet; however, in such cases, there is often a need to provide means for avoiding edge curl.

The arrangement illustrated in FIG. 29 provides for strips 292 in the sheet, for example ½ inch in width, which have been heat treated in preference to the areas intermediate the strips. This could be accomplished, for example, by exposing a sheet of Mylar to heaters having localized heat application so that substantial areas of unheat-treated Mylar are located between areas which have been heat treated. This will result in a structure which will self-coil but since there are substantial areas along the respective edges which do not have the coiling memory, edge curl will be minimized or eliminated.

Preferential heat treatment to achieve the pattern of FIG. 29 can also be accomplished by coating the Mylar selectively with microwave absorbing material, such as a metallic paint. When coiled and exposed to microwave radiation, only the selected areas will influence the memory imparted to the sheet. As will be apparent from a consideration of other embodiments described herein, microwave treatment is applicable to the achievement of a wide variety of different patterns.

Figure 30:
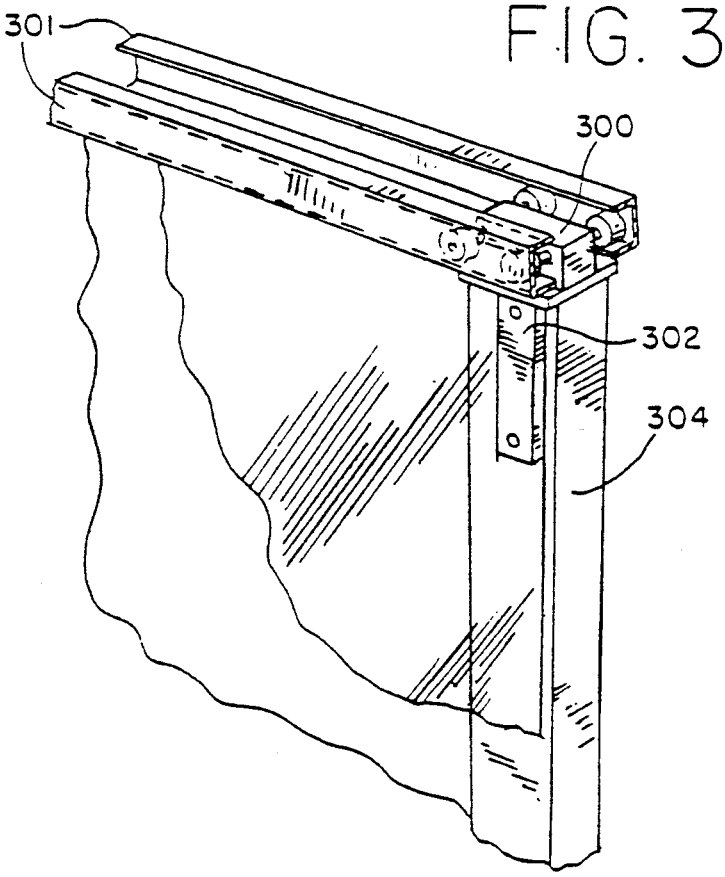
FIG. 30 is a perspective view of a trolley mechanism for top support of the lead edge of a sheet.

FIG. 30 addresses another characteristic of a self-coiling sheet. In such sheets, there is a tendency for a handlebar member such as the member 21 associated with sheet 20 in FIG. 1, to pivot away from the vertical. This is particularly characteristic of an arrangement wherein the upper end of the front edge of the sheet is supported but the lower end is free for movement back toward the coil enclosure.

One solution to the problem is shown in FIG. 9, for example, wherein both the upper and lower ends of the handlebar 21 are confined. Another solution is simply to provide a weight at the lower end of the handlebar to offset any tendency toward moving out of a vertical position.

FIG. 30 illustrates an additional approach to the problem wherein a four-wheel trolley 300 is movable in upper supporting tracks 301. A bracket 302 extends downwardly from the trolley for attachment to a handlebar 304. In the assembly steps for this embodiment, the bracket is attached to the handlebar with the handlebar at right angles to a plane extending parallel with the respective axes of the trolley wheels. Since the four-wheel trolley is confined within the tracks to prevent movement out of this plane, the handlebar 304 will be locked in a vertical position by bracket 302 and will automatically maintain a vertical relationship with that plane. Thus, the bracket 302 provides a moment of force tending to resist pivoting of the handlebar out of a vertical alignment.

Figure 31:
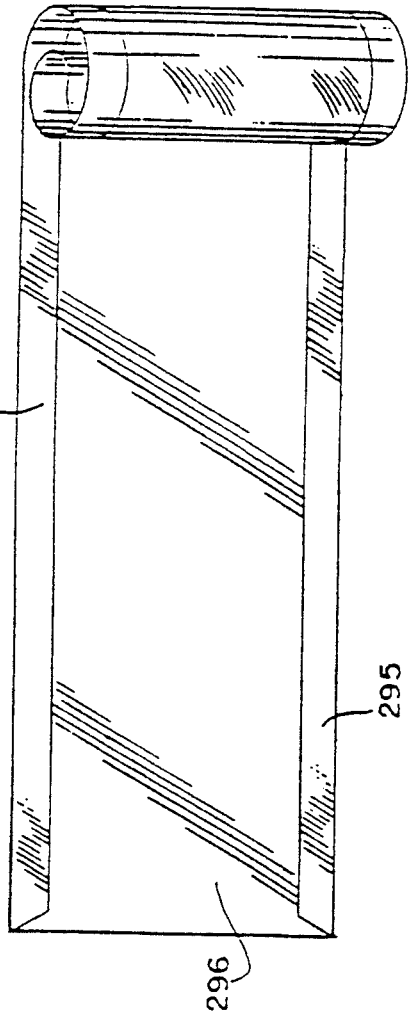
FIG. 31 is a perspective view of a sheet having a turned-in edge for edge curl control.

FIG. 31 illustrates an alternative means for controlling edge curl. In this instance, upper and lower edges 294 and 295 of a sheet 296 have been folded over, for example in the manner shown in FIG. 19, by use of a hot iron, for example. When coiled and heat-treated to provide memory, the reinforcement provided is effective against edge curl. When combined with a guide channel, such as the channel 38 of FIG. 5, the minimum amount of space available also confines the edges to eliminate any significant curling.

Figure 33:
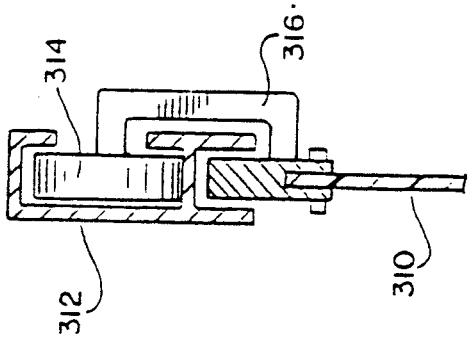
FIG. 33 is an enlarged fragmentary cross-sectional view of the top edge support mechanism shown in FIG. 32.
Figure 32:
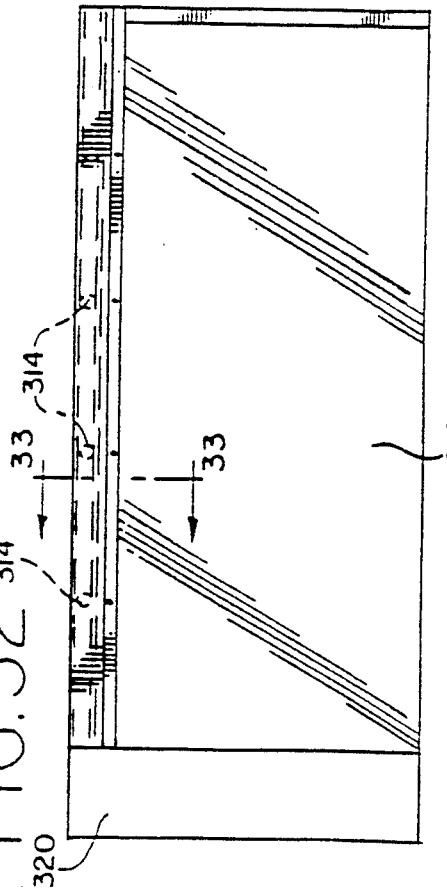
FIG. 32 is a front elevational view of a variation of the invention applied to a closure with multiple top edge support.

FIGS. 32 and 33 illustrate the provision of intermediate top edge support for a sheet 310. Specifically, a channel-shaped track 312 is provided for receiving guide wheels 314. Fixtures 316 are employed for attaching the guide wheels along the upper edge of the sheet 310 whereby the sheet is provided with support at spaced intervals. This arrangement is particularly suitable for sheets which have a relatively great horizontal extent.

Figure 33A:
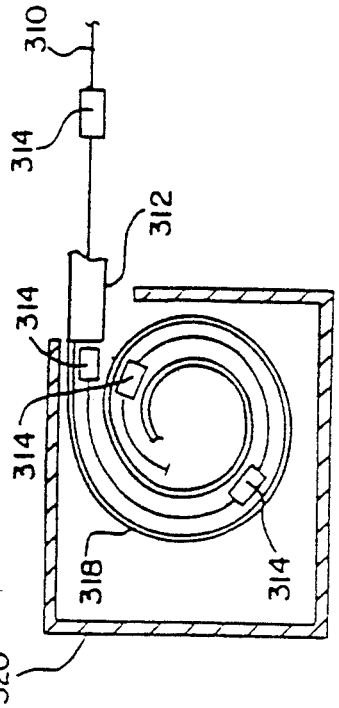
FIG. 33A comprises a schematic illustration of a collector raceway usable with the top edge support of FIG. 32.

A collector raceway 318 shown in FIG. 33A, comprising a spiral extension of channel 312, is provided for the rollers 314 when the sheet is coiled to the retracted position. This raceway can be readily mounted at the top of the enclosure, and it will be appreciated that this provides means for supporting the sheet when it is confined within the roll enclosure 320 in addition to having support for the sheet when extended.

Figure 34:
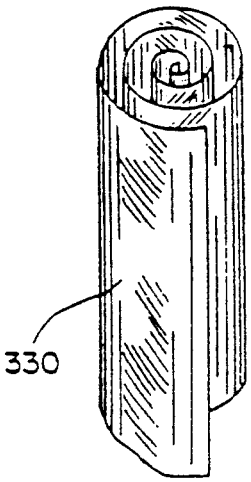
FIG. 34 is a schematic fragmentary perspective view of a coiled sheet characterized by a "watch spring" memory set.

FIG. 34 provides a schematic illustration of a sheet 330 shown in the coiled position as in a watch spring. Thus, it will be noted that the opposing faces of the sheet are in a spaced-apart relationship which is due to the particular memory incorporated in the sheet. To achieve this, a sheet without memory is held in a coiled condition without adjacent sheet faces being in contact by providing, for example, an intermediate spacing means which is coiled with the sheet. After heat treating, the sheet will be provided with a memory which will avoid contact, and this arrangement is particularly valuable for a shower application or other system where water may collect on the sheet surfaces. With air space available between the surfaces, there is an opportunity for the water to evaporate to minimize any problems which might otherwise develop.

Figure 35:
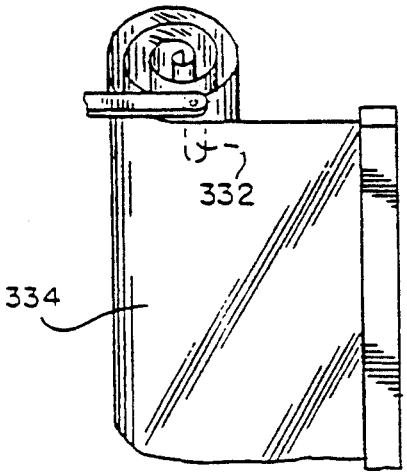
FIG. 35 is a schematic fragmentary perspective view of a sheet with the watch spring memory set combined with a spacer.

FIG. 35 illustrates alternative means for maintaining sheet surfaces in a spaced-apart relationship. In this instance, a roller 332 is positioned at the location where the sheet is in a coiled condition. This roller may, for example, extend vertically downwardly from the upper horizontal frame and into the frame enclosure such as the enclosure 32 of FIG. 2. As shown in FIG. 35, the surfaces of sheet 334 are held apart by the roller during withdrawing and retracting of the sheet, thereby preventing collapsing of the spiral. Additional inwardly located rollers may extend downwardly within the enclosure for the coiled sheet to further insure this spacing result.

Figure 37:
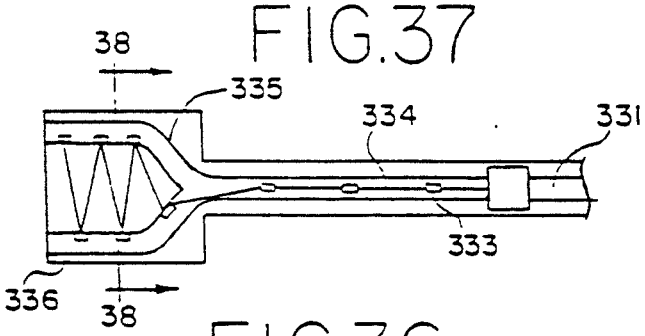
FIG. 37 is an end view of the top support track for the accordion-type sheet of FIG. 36.
Figure 36:
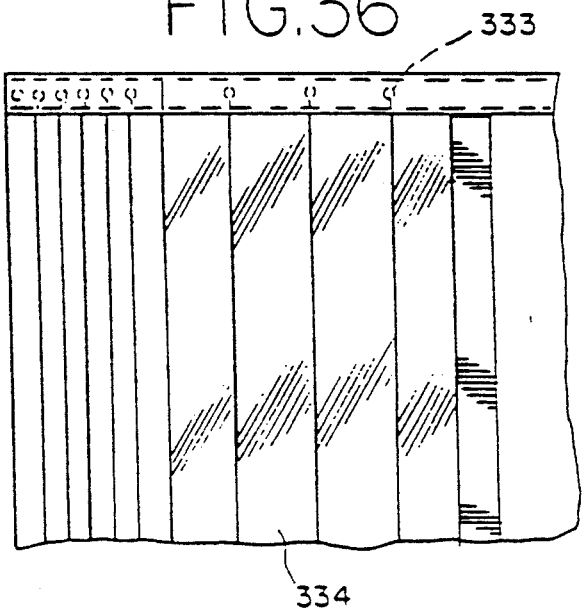
FIG. 36 is a front elevational view of a variation of the invention which includes a sheet with "accordion" memory.
Figure 38:
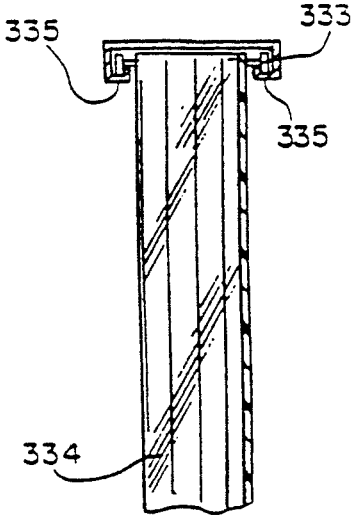
FIG. 38 is a top end view of the box enclosure for the sheet of FIG. 36.

FIGS. 36, 37 and 38 schematically illustrate an arrangement where the sheet 334 is disposed in a compact accordion fashion when in the retracted position. This arrangement has particular value for water containment applications since inner and outer surfaces of the self-coiling sheet cannot come into contact. Again, the particular configuration of the sheet in the retracted position is dependent upon the memory which is introduced into the sheet and the accordion configuration can be provided in the memory in essentially the same manner as a coiled configuration, that is, by forming the untreated sheet in accordion fashion and then heat treating to achieve that memory.

As shown in FIGS. 37 and 38, the accordion arrangement may include a plurality of intermediate roller supports 333 engageable with tracks 331 as discussed with reference to FIG. 32. In this instance, the collector raceway 335 comprises two oppositely disposed areas of the enclosure 336 utilized for the sheet 334. As the sheet is retracted, alternate rollers 333 will automatically be directed into one side of the raceway as a result of the memory in the sheet 334.

Figure 39:
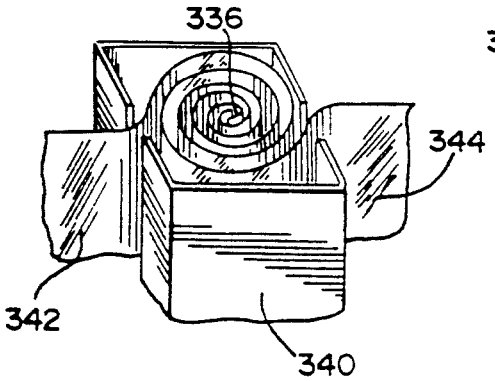
FIG. 39 is a perspective view of a variation of the invention using a double coil sheet configuration.

FIG. 39 illustrates an application of the invention wherein a centrally located enclosure 340 is provided for receiving respective self-coiling sheets 342 and 344. In this instance, the sheets are attached along adjoining edges at 336 so that the adjacent sheets form a double coil when in the fully retracted position. As the sheets are simultaneously extended in opposite directions, the sheets uncoil simultaneously whereby the sheets will extend and close openings on opposite sides of the enclosure 340. When it is desired to return the sheets to the retracted position, the coiling memory of each sheet assists in the retracting action. If desired, this configuration could be used with only one sheet being provided with self-coiling memory since the action of one sheet will automatically be imparted to the other sheet.

Figure 40:
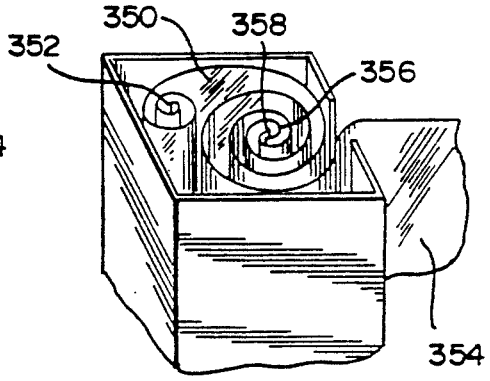
FIG. 40 is a perspective view of a variation of the invention using an alternative form of double coil sheet.

FIG. 40 illustrates an optional coil arrangement wherein a first sheet 350 is adapted to coil around axis 352, and a second sheet 354 is adapted to coil around axis 356. The sheets are attached at adjoining edges 358 and, as the sheet 354 is extended, the uncoiling is resisted by any memory of this sheet as well as by the coiling memory of the sheet 350. Similarly, moving of the sheet 354 to the fully retracted position is achieved by means of the memory of both sheets 350 and 354. If desired, this retracting function could be achieved by utilizing memory only in the sheet 350.

Figure 41:
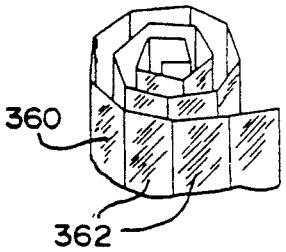
Figure 41A:
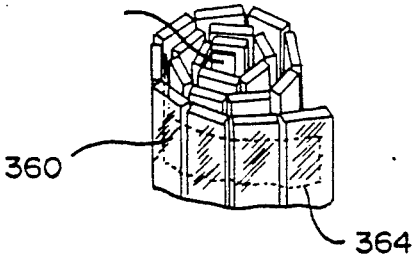
FIG. 41A schematically illustrates a method for achieving the flat segments in the sheet shown in FIG. 41.

FIG. 41 illustrates a sheet 360 which is provided with memory such that short linear segments 362 are formed. This can be accomplished, for example, by exposing an untreated sheet to a heated rollable surface (such as aluminum slats) having flats defined on its surface. Specifically, and as shown in FIG. 41A, aluminum slats 364 are wound into a tight bundle with the thin polyester sheet conforming to the flat surfaces of the slats. When heat is applied, a memory is imparted such that the configuration of FIG. 41 for the coil is achieved. In this connection, an automatic separation or "watch spring" effect is achieved since the slats hold the surfaces of sheet 360 spaced apart while heat is being applied. In the illustrated example, the sheet 360 underlies the slats 364 in the manner of a tambour backing so that tambour slats of the same dimensions as the aluminum slats can be readily applied to the sheet.

When so formed, each of the segments on the sheet will be flat, and when the sheet is extended, a flat overall surface will be achieved. When the sheet is returned to a coiled condition, however, the flat segments will be at small angles relative to each other.

The arrangement of FIG. 41 is particularly suited for use with slats which are attached to individual sheet segments to thereby achieve a tambour appearance. In particular, by eliminating curvature in the sheet segments, greater surface-to-surface contact for the slats is achieved thereby enhancing the bonding relationship between the slats and the sheet surface. In this connection, it is only necessary to bond at some locations, for example at top and bottom, rather than having complete surface-to-surface bonding.

Figure 42:
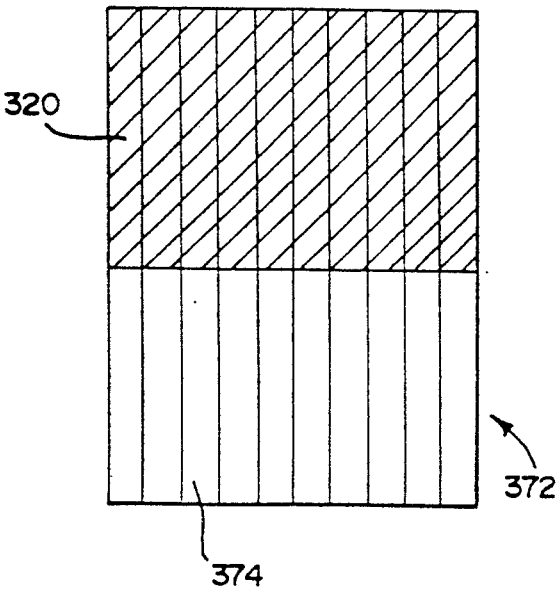
FIG. 42 is a plan view of a sheet with memory partially covering a tambour arrangement; and, FIG. 43 is a plan view of an alternative form of sheet with memory partially covering a tambour arrangement.
Figure 43:
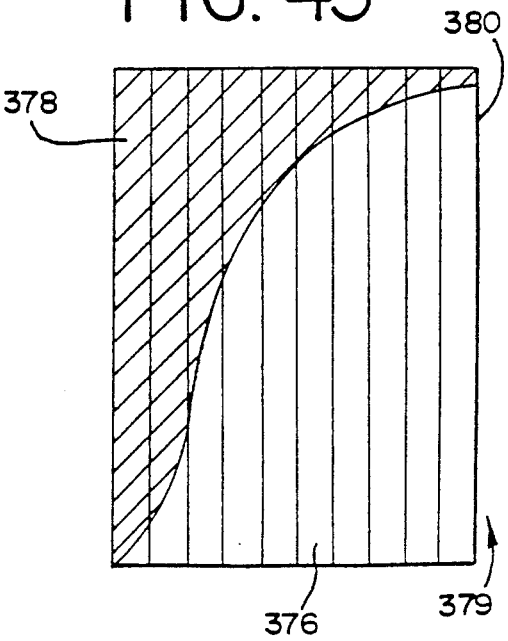

FIGS. 42 and 43 are intended to illustrate sheets which are applied to only portions of a door or other construction which is intended to have the self-coiling ability. In FIG. 42, a sheet 370 (shown with cross hatching) covers only approximately half of the door assembly 372 which otherwise includes tambour slats 374 mounted on a backing such as shown in FIG. 11. In FIG. 43, the tambour slats 376 forming door 379 are partially covered with a self-coiling sheet 378. This sheet is intended to extend the complete height of the door at the left-hand side of the sheet with the handlebar 380 located at the right-hand of the sheet. It will be appreciated that the recoiling force initially required when the sheet is at the fully extended position is rather small which accounts for the limited amount of a sheet portion with memory at this location. On the other hand, as the sheet moves closer to a fully coiled position, higher recoiling forces are required, and this accounts for the greater extent of self-coiling sheet in this location.

This arrangement permits savings in that the amount of Mylar or other such material used can be reduced. It will be appreciated, however, that substantially the same functional results could be achieved by selectively heat treating portions of a complete sheet.

While the invention has been described with reference to preferred embodiments, it is not so limited. Many modifications will now occur to persons skilled in the art. For a definition of the invention, reference is made to the following claims.

We claim:

1. A flexible retractable closure assembly for an opening comprising:

a flexible sheet having front and rear end edges and side edges extending laterally between the end edges, said sheet having a permanent memory set to gather itself automatically into a compact configuration proximate said rear edge, locating means retaining said compact configuration at one side of said opening, guide means guiding said sheet from the locating means across the opening, retaining means for holding the sheet in an extended position whereby the sheet extends at least partially over said opening, and wherein by the sheet moving from said locating means, the sheet is movable between:

(a) a retracted position with the front end edge near the locating means and the substantial entirety of the sheet in a compact state, and (b) said extended position with the front end edge spaced from the locating means and a substantial portion of the sheet extending across the opening said sheet includes stiffening means, wherein said stiffening means comprise vertically extending slats attached to said sheet in side-by-side fashion, said slats providing a tambour effect to said sheet.

2. An assembly as claimed in claim 1 wherein said compact configuration comprises a coil.

3. An assembly as claimed in claim 1 including retaining means to retain the sheet in the retracted position and in positions intermediate the retracted and extended positions.

4. An assembly as claimed in claim 1 wherein said sheet is rectangular, said guide means comprising channel means receiving and guiding at least one of said side edges therein.

5. An assembly as claimed in claim 2 wherein said locating means comprise vertical axle means centrally within said coil.

6. An assembly as claimed in claim 5 including coil support surfaces under the coil supporting the coil by contact with the lower side edge.

7. An assembly as claimed in claim 6 wherein the coil support surfaces are low friction surfaces to facilitate uncoiling and sliding of the lower side edge of the coil thereon.

8. An assembly as claimed in claim 7 wherein the coil support surfaces are journalled for rotation about a vertical axis substantially coincident with the axis of said coil.

9. An assembly as claimed in claim 1 wherein said sheet comprises polyester film thermally treated to have said permanent coil set.

10. An assembly as claimed in claim 9 wherein said sheet comprises Mylar (trademark) brand film.

11. An assembly as claimed in claim 1 including a weight positioned for vertical movement at the side of said opening opposite said locating means, and means extending between and attached to said weight and said front edge whereby the weight operates to assist in movement of the sheet between retracted and extended positions.

12. An assembly according to claim 1 including an upper guide rail, and means defined by said slats engaging said rail to thereby provide support for said sheet.

13. An assembly according to claim 1 wherein said sheet is thermally treated to provide a plurality of side-by-side, vertically extending flat areas separated by crease lines, and a slat secured to each flat area.

14. An assembly as claimed in claim 1 including means positioned at the side of said opening opposite said locating means for urging said sheet to the extended position, and means extending between and attached to said urging means and to said front end edge whereby the urging means assists in movement of the sheet to the extended position.

15. An assembly according to claim 14 wherein said urging means comprises a weight, and a cord extending between said weight and front end edge.

16. An assembly according to claim 1 wherein said opening comprises the access opening to a cabinet.

17. An assembly according to claim 1 wherein said guide means include a support extending across said opening along the path of movement of the top side edge of said sheet, and means attached to said sheet and movable relative to said support whereby said support assists in maintaining said sheet in said path of movement.

* * * * *